US011176779B2

(12) United States Patent
Cormack

(10) Patent No.: US 11,176,779 B2
(45) **Date of Patent: *Nov. 16, 2021**

(54) GAMING MACHINE AND METHOD WITH A BONUS SYMBOL ARRAY

(71) Applicant: Ainsworth Game Technology Limited, Newington (AU)

(72) Inventor: William George Cormack, Dural (AU)

(73) Assignee: Ainsworth Game Technology Limited, Newington (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/871,651

(22) Filed: May 11, 2020

(65) Prior Publication Data

US 2020/0273294 A1 Aug. 27, 2020

Related U.S. Application Data

(63) Continuation of application No. 15/802,428, filed on Nov. 2, 2017, now Pat. No. 10,650,639.

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3267* (2013.01); *G07F 17/3213* (2013.01); *G07F 17/3258* (2013.01); *G07F 17/3262* (2013.01)

(58) Field of Classification Search

CPC .. G07F 17/32; G07F 17/3213; G07F 17/3258; G07F 17/326; G07F 17/3262; G07F 17/3267; G07F 17/34

See application file for complete search history.

(56) References Cited

U.S. PATENT DOCUMENTS

| | | | | |
|---|---|---|---|---|
| 6,935,947 | B1 | 8/2005 | Singer et al. | |
| 2005/0043082 | A1* | 2/2005 | Peterson | G07F 17/32 463/20 |
| 2005/0059455 | A1* | 3/2005 | Gerrard | G07F 17/32 463/16 |
| 2005/0075163 | A1* | 4/2005 | Cuddy | G07F 17/3244 463/20 |
| 2006/0058097 | A1 | 3/2006 | Berman et al. | |
| 2006/0068893 | A1 | 3/2006 | Jaffe et al. | |
| 2009/0075722 | A1 | 3/2009 | Louie et al. | |
| 2010/0016071 | A1 | 1/2010 | Jaffe et al. | |

(Continued)

*Primary Examiner* — Milap Shah

(74) *Attorney, Agent, or Firm* — Cook Alex Ltd.

(57) ABSTRACT

A gaming machine comprises a display and an electronic controller for playing a first game. The electronic controller is configured to randomly determine whether to display one or more bonus symbols in the first game, each bonus symbol being associated with a bonus value award. Where a trigger event occurs during the first game, such as the appearance of a predetermined order of bonus symbols, electronic controller is configured to display an array of the bonus symbols on the display or optionally on another display. Where bonus symbols appear in further plays of the first game or plays of a second game, the bonus symbols are added to the array and bonus symbols present on the array are sequentially transferred to a win meter, which increments by the amount of the associated bonus value award of each transferred bonus symbol.

20 Claims, 16 Drawing Sheets

(56) References Cited

U.S. PATENT DOCUMENTS

| | | | |
|---|---|---|---|
| 2010/0120489 | A1 | 5/2010 | Meyer |
| 2011/0117989 | A1 | 5/2011 | Kennedy et al. |
| 2011/0136565 | A1 | 6/2011 | Low |
| 2013/0157741 | A1 | 6/2013 | Pacey et al. |
| 2014/0018146 | A1 | 1/2014 | Zielinski et al. |
| 2014/0364193 | A1 | 12/2014 | Williamson et al. |
| 2015/0094132 | A1 | 4/2015 | Elias et al. |
| 2015/0141114 | A1 | 5/2015 | Davis et al. |
| 2016/0314644 | A1 | 10/2016 | Meyer et al. |

* cited by examiner

GAMING MACHINE AND METHOD WITH A BONUS SYMBOL ARRAY

This application is a continuation of U.S. patent application Ser. No. 15/802,428, filed Nov. 2, 2017, which application is incorporated by reference herein.

BACKGROUND

The present disclosure relates to a gaming machine and method. The present disclosure has been developed primarily for use as an electronic gaming machine and will be described hereinafter by reference to this application. However, it will be appreciated that the present disclosure may also be implemented for any type of gaming machine, including a mechanical or electro-mechanical gaming machine.

The following discussion of the prior art is intended to present the present disclosure in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

One type of gaming machine comprises a mechanical or electro-mechanical device, where a motor rotates a plurality of annular rings or drums that form reels. Each reel has a reel strip that displays game symbols in preset game symbol positions. A frame covers the rings to provide a window through which only a subset of game symbol positions (and hence game symbols) were visible to the player. Thus, for a game using a 5×3 array, the window would only permit three rows of five rings to be visible to create the game array. An internal electronic controller within the gaming machine controls operation of the motor and hence rotation of the reels. Thus, by controlling when each reel starts and stops in its respective rotation, the electronic controller controls the display of the game symbols in the window. Sensors linked to the reels indicate which game symbols are displayed in the window and communicate with the electronic controller so that the electronic controller is able to award prizes based on winning combinations of game symbols displayed on the reels in the window. The electronic controller typically comprises one or more electric circuits for controlling various functions of the gaming machine, such as the above mentioned control of the motor, communicating with the sensors, verifying that the correct amount of a bet has been made via one or more value receiving mechanisms to enable operation of the motors, controlling any visual and/or audio effects associated with operation of the gaming machine and controlling operation of various alarms to alert any tampering with the gaming machine.

Another type of gaming machine, known as an electronic gaming machine or EGM, replaces the mechanical reels and motor with a video display screen on which video images of the reels are displayed. The EGM has an internal electronic game controller, typically a computer, that controls the display of images on the video display screen so that the reels are visibly spun on the screen to simulate a physical reel of a traditional gaming machine. EGMs tend to be more versatile in providing game information, varying the probabilities for a player to win a prize and varying the type of game that is played.

Bonus or "feature" games may also be provided by a gaming machine in addition to a base or main game. Typically feature games use the same set of reels as the main game and are limited to a set of free games operated under a single set of rules. This means that the feature game is restricted by the same set of rules, and so there is no variation in the play of the feature game. Also, gaming machines can offer one or more bonus prizes to the player during play of the game. The most common type of bonus prize that is awarded by the gaming machine is a jackpot prize, the main example of which is a progressive jackpot prize.

This standard structure to game play and bonus prizes limits the operation of the gaming machine, irrespective of whether it is a mechanical, electro-mechanical or electronic gaming machine. Consequently, it is difficult to retain player interest because there is no apparent incentive for the player to continue playing the gaming machine once the player becomes familiar with the feature game, the main game and any bonus prizes.

It is an object of the present disclosure to overcome or substantially ameliorate one or more of the disadvantages of prior art, or at least to provide a useful alternative.

SUMMARY

The present disclosure provides a gaming machine that has improved operation and performance relative to existing prior art gaming machines by providing a more efficient way of awarding prizes to a player of the gaming machine (such as providing more symbols on the display that can be usually displayed) and in a more entertaining manner compared to presently existing gaming machines. The present disclosure also improves the application of an electronic controller in playing the game on the gaming machine.

One embodiment of the present disclosure provides a gaming machine comprising:

at least one display; and an electronic controller coupled to a display, the electronic controller being configured to:

display a first game on the at least one display including one or more configurations of game symbols, one or more of the configurations of game symbols being associated with a winning game outcome, the winning game outcome being associated with a value award payable to a player;

randomly determine whether to display one or more bonus symbols in the first game, each bonus symbol being associated with a bonus value award;

in response to a trigger event occurring in a first play of the first game, display an array of the bonus symbols on the at least one display; and add bonus symbols to the array as they appear in one or more subsequent plays of the first game.

A further embodiment of the present disclosure provides a gaming machine comprising:

at least one display;

an electronic controller coupled to a display, the electronic controller being configured to display a first game on the at least one display including one or more configurations of game symbols, one or more of the configurations of game symbols being associated with a winning game outcome, the winning game outcome being associated with a value award payable to a player; and a value transfer mechanism for receiving value from the player, wherein the electronic controller communicates with the value transfer mechanism such that when a threshold amount of value has been received from the value transfer mechanism, the electronic controller initiates a play of the first game;

the electronic controller being further configured to:

randomly determine whether to display one or more bonus symbols in the first game, each bonus symbol being associated with a bonus value award;

in response to a trigger event occurring in a first play of the first game, display an array of the bonus symbols on the at least one display; and add bonus symbols to the array as they appear in one or more subsequent plays of the first game.

Yet another embodiment of the present disclosure provides a gaming machine comprising:

at least one display;

a value input comprising at least one of a coin acceptor, a bill acceptor and a ticket reader, and at least one electronic controller coupled to the at least one display and the value input, the at least one controller configured:

to determine if a wager has been received via the value input;

to display a first game on the at least one display including one or more configurations of game symbols if a wager has been received, one or more of the configurations of game symbols being associated with a winning game outcome, the winning game outcome being associated with a value award payable to a player;

randomly determine whether to display one or more bonus symbols in the first game, each bonus symbol being associated with a bonus value award;

in response to a trigger event occurring in a first play of the first game, display an array of the bonus symbols on the at least one display; and add bonus symbols to the array as they appear in one or more subsequent plays of the first game.

A further embodiment of the present disclosure provides a gaming machine comprising:

at least one electronic video display;

a value input comprising at least one of a coin acceptor, a bill acceptor and a ticket reader; and at least one electronic controller coupled to the at least one electronic video display and the value input, the at least one controller configured:

to determine if a wager has been received via the value input;

to display a first game on the at least one electronic video display if a wager has been received;

a play of the first game including a plurality of randomly selected game symbols arranged in a plurality of reels, one or more of the configurations of the randomly selected game symbols arranged along a pay line being associated with a winning game outcome, the winning game outcome being associated with a value award payable to a player;

to randomly determine whether to display one or more bonus symbols on the reels in the first game, each bonus symbol being associated with a bonus value award;

in response to a trigger event occurring in a first play of the first game, to display an array of the bonus symbols on the at least one electronic video display separate to the reels; and upon the appearance of one or more bonus symbols in the one or more subsequent plays of the first game, to add the one or more bonus symbols to the array.

A yet further embodiment of the present disclosure provides a gaming machine comprising:

at least one electronic video display;

a value input comprising at least one of a coin acceptor, a bill acceptor and a ticket reader; and at least one electronic controller coupled to the at least one electronic video display and the value input, the at least one controller configured:

to determine if a wager has been received via the value input;

to display a first game on the at least one electronic video display if a wager has been received;

a play of the first game including a plurality of randomly selected game symbols arranged in a plurality of reels, one or more of the configurations of the randomly selected game symbols arranged along a pay line being associated with a winning game outcome, the winning game outcome being associated with a value award payable to a player;

to randomly determine whether to display one or more bonus symbols on the reels in the first game, each bonus symbol being associated with a bonus value award;

in response to a trigger event occurring in a first play of the first game, to display an array of the bonus symbols on the at least one display separate to the reels for one or more plays of a second game; and upon the appearance of one or more bonus symbols in the one or more subsequent plays of the second game, to add the one or more bonus symbols to the array.

An additional embodiment of the present disclosure provides a method comprising:

displaying a first game on at least one display including one or more configurations of game symbols, one or more of the configurations of game symbols being associated with a winning game outcome, the winning game outcome being associated with a value award payable to a player;

randomly determining whether to display one or more bonus symbols in the first game; and associating each bonus symbol being associated with a bonus value award;

in response to a trigger event occurring in a first play of the first game, displaying an array of the bonus symbols on the at least one display; and adding bonus symbols to the array as they appear in one or more subsequent plays of the first game.

A yet further embodiment provides a method comprising:

receiving value via a value transfer mechanism;

determining whether the received value meets a threshold amount;

initiating a play of a first game if the received value is equal to or greater than the threshold amount;

displaying the first game on at least one display including one or more configurations of game symbols, one or more of the configurations of game symbols being associated with a winning game outcome, the winning game outcome being associated with a value award payable to a player;

randomly determining whether to display one or more bonus symbols in the first game; and associating each bonus symbol being associated with a bonus value award;

in response to a trigger event occurring in a first play of the first game, displaying an array of the bonus symbols on the at least one display; and adding bonus symbols to the array as they appear in one or more subsequent plays of the first game.

Yet another embodiment provides a method comprising:

determining if a wager has been received via a value input comprising at least one of a coin acceptor, a bill acceptor and a ticket reader;

displaying a first game including one or more configurations of game symbols if a wager has been received, one or more of the configurations of game symbols being associated with a game outcome, the game outcome being associated with a value award payable to a player;

randomly determining whether to display one or more bonus symbols in the first game; and associating each bonus symbol being associated with a bonus value award;

in response to a trigger event occurring in a first play of the first game, displaying an array of the bonus symbols; and adding bonus symbols to the array as they appear in one or more subsequent plays of the first game.

A still further embodiment provides a method comprising:

determining if a wager has been received via a value input comprising at least one of a coin acceptor, a bill acceptor and a ticket reader;

displaying a first game if a wager has been received;

a play of the first game including a plurality of randomly selected game symbols arranged in a plurality of reels, one or more of the configurations of the randomly selected game symbols arranged along a pay line being associated with a game outcome, the game outcome being associated with a value award payable to a player;

randomly determining whether to display one or more bonus symbols in the first game; and associating each bonus symbol being associated with a bonus value award;

in response to a trigger event occurring in a first play of the first game, displaying an array of the bonus symbols; and adding bonus symbols to the array as they appear in one or more subsequent plays of the first game.

Yet another embodiment provides a method comprising:

determining if a wager has been received via a value input comprising at least one of a coin acceptor, a bill acceptor and a ticket reader;

displaying a first game if a wager has been received;

a play of the first game including a plurality of randomly selected game symbols arranged in a plurality of reels, one or more of the configurations of the randomly selected game symbols arranged along a pay line being associated with a game outcome, the game outcome being associated with a value award payable to a player;

randomly determining whether to display one or more bonus symbols in the first game; and associating each bonus symbol being associated with a bonus value award;

in response to a trigger event occurring in a first play of the first game, displaying an array of the bonus symbols for one or more plays of a second game; and adding bonus symbols to the array as they appear in the one or more plays of the second game.

A further embodiment provides a computer system comprising a central processing unit configured for communication with a gaming machine, wherein the computer system is configured to perform the method of any one of the above described embodiments of the present disclosure.

A further embodiment provides a computer program configured to perform the method of any one of the above described embodiments of the present disclosure.

A further embodiment provides a non-transitory carrier medium carrying computer executable code that, when executed on a central processing unit configured for communication with a gaming machine, causes the central processing unit to perform the method of any one of the above described embodiments of the present disclosure.

Throughout the specification and unless explicitly stated otherwise, the term "value" means credits, gaming tokens, coins, paper, currency, tickets, vouchers, credit cards, debit cards, smart cards, memory devices capable of storing value and any other object representative of value.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

The disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

Figure 1:
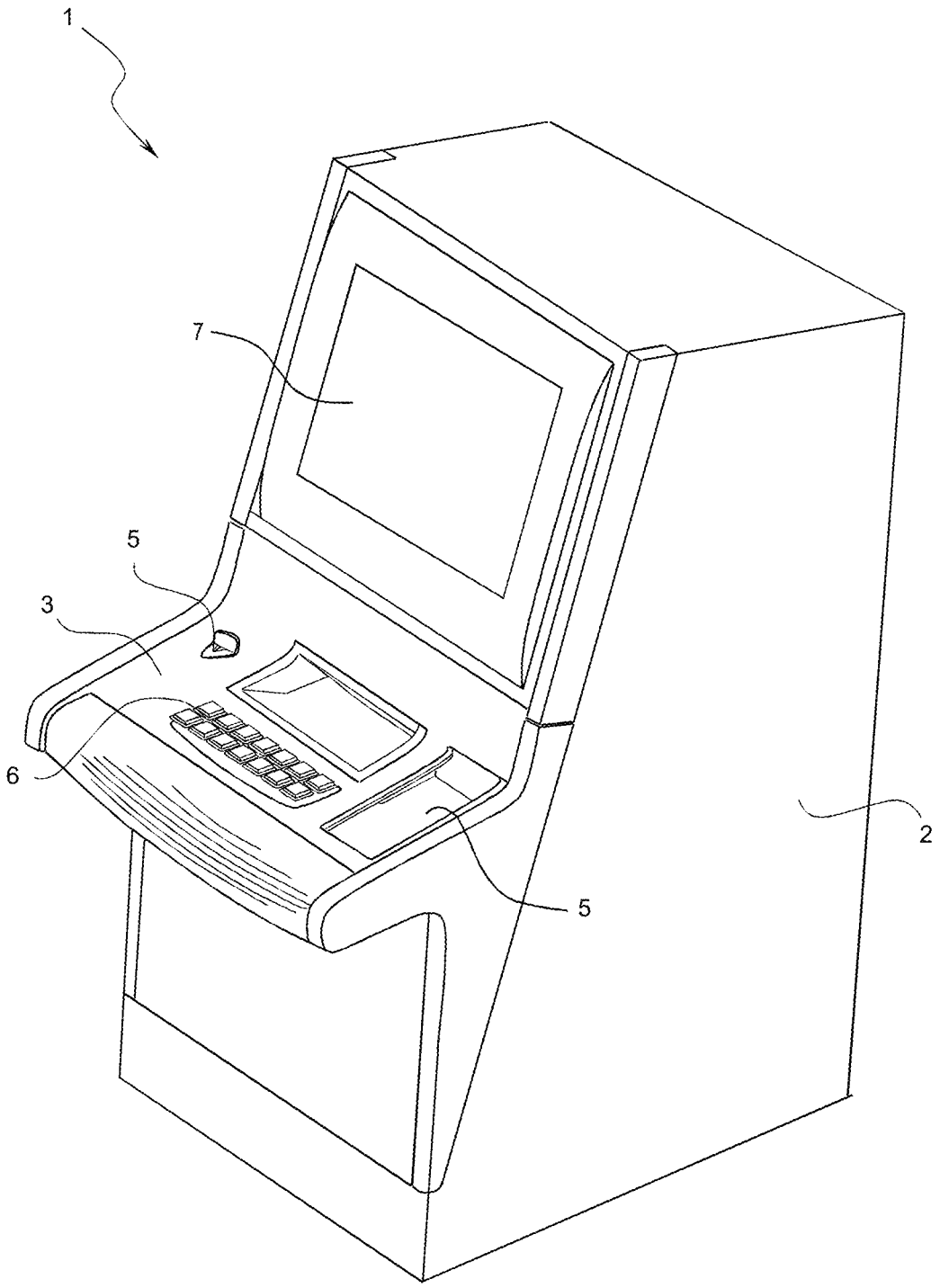
FIG. 1 is a perspective view of a gaming machine according to a first embodiment of the present disclosure.

The present disclosure will now be described with reference to the following examples which should be considered in all respects as illustrative and non-restrictive. In the Figures, corresponding features within the same embodiment or common to different embodiments have been given the same reference numerals.

In general terms, a gaming machine according to the embodiments described herein includes at least one display, and an electronic controller coupled to the at least one display. In some embodiments, the gaming machine comprises a value transfer mechanism or a value input that is coupled to the electronic controller. Where the electronic controller is configured to communicate with the value transfer mechanism, and a threshold amount of value has been received from the value transfer mechanism, the electronic controller initiates a play of the first game. Where electronic controller is coupled to a value input, it is configured to determine if a wager has been received via the value input and display a first game on the at least one electronic video display if a wager has been received. The first game may include one or more configurations of game symbols, one or more of the configurations of game symbols being associated with a winning game outcome, the winning game outcome being associated with a value award payable to a player. Alternatively, the first game may include a plurality of randomly selected game symbols arranged in a plurality of reels, one or more of the configurations of the randomly selected game symbols arranged along a pay line being associated with a winning game outcome, the winning game outcome being associated with a value award payable to a player.

The electronic controller in one embodiment is configured to randomly determine whether to display one or more bonus symbols in the first game, each bonus symbol being associated with a bonus value award; in response to a trigger event occurring in a first play of the first game, display an array of the bonus symbols on the at least one display; and add bonus symbols to the array as they appear in one or more subsequent plays of the first game.

In another embodiment, the electronic controller is configured to randomly determine whether to display one or more bonus symbols on the reels in the first game, each bonus symbol being associated with a bonus value award; in response to a trigger event occurring in a first play of the first game, to display an array of the bonus symbols on the at least one display separate to the reels for one or more plays of a second game; and upon the appearance of one or more bonus symbols in the one or more subsequent plays of the second game, to add the one or more bonus symbols to the array.

In some embodiments, the trigger event comprises the appearance of a predetermined number of bonus symbols in the first play of the first game. In other embodiments, the bonus symbols appearing in the first play of the first game are arranged in the array for the next play of the one or more subsequent plays of the first game. In a further embodiment, one or more of the bonus symbols appearing in the first play of the first game are arranged in array positions of the array corresponding to their respective positions in the first play of the first game.

In some embodiments, bonus symbols are sequentially transferred from the array in response to bonus symbols being added to the array. In other embodiments, each transferred bonus symbol moves to a win meter so that the amount of the win meter increases by the amount of the bonus value award associated with the transferred bonus symbol.

In some embodiments, the array comprises a predetermined number of array positions occupied by the bonus symbols. In one embodiment, bonus symbols are transferred from the array when the number of bonus symbols and additional bonus symbols exceeds the predetermined number of array positions. In a further embodiment, wherein each transferred bonus symbol moves to a win meter that increments by the amount of the bonus value award associated with the transferred bonus symbol.

In another embodiment, the bonus symbols move from one array position to another array position when an additional bonus symbol is added to the array. In yet another embodiment, the bonus symbol occupying a designated exit array position is transferred from the array when an additional bonus symbol is added to the array. In a further embodiment, the transferred bonus symbol is moved to a win meter so that the amount of the win meter increases by the amount of the bonus value award associated with the transferred bonus symbol.

In some embodiments, the array positions define a path along which each additional bonus symbol moves from an entry array position to an exit array position. In other embodiments, the bonus symbol occupying the exit array position is transferred from the array when an additional bonus symbol is added to the entry array position. In a further embodiment, the transferred bonus symbol is moved to a win meter so that the amount of the win meter increases by the amount of the bonus value award associated with the transferred bonus symbol.

In some embodiments, the bonus symbols are arranged in a predetermined order in the array. In other embodiments, the bonus symbols are transferred from the array according to the predetermined order when additional bonus symbols are added to the array.

In some embodiments, the first game comprises a base game and a feature game, the first play of the first game being a play of the base game and the one or more subsequent plays of the first game being plays of the feature game.

In some embodiments, the at least one display comprises a first display and a second display, wherein the first game is shown on the first display and the array is shown on the second display.

Referring to FIG. 1, a gaming machine 1 according to a first embodiment includes a cabinet 2, a console 3 and an internal electronic controller 4. The console 3 has various input devices including value inputs, such as vending slots 5 for receiving monetary bets, and a plurality of buttons 6 for actuation by a player. It will be appreciated that in other embodiments the vending slots 5 may be replaced with other types of value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the gaming machine 1. Other forms of value include gaming tokens, paper, tickets, vouchers, and any other object representative of value.

Figure 2:
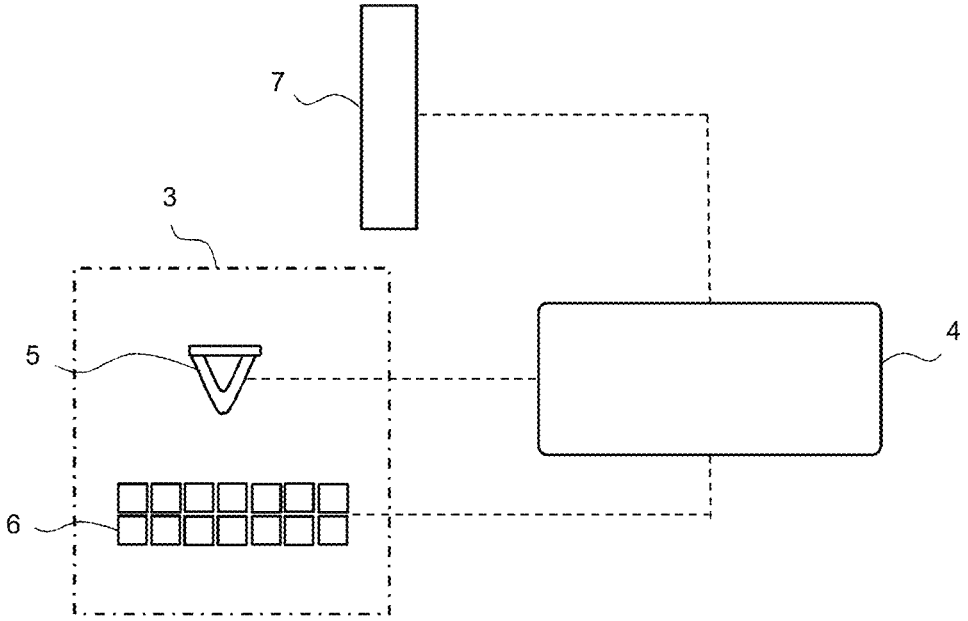
FIG. 2 is a schematic drawing of an electronic controller for the gaming machine of FIG. 1.

The electronic controller 4 is generally in the form of an electronic game controller comprising a central processing unit, such as a computer, and is in electronic communication with a display in the form of a video display screen 7, as well as various input devices on the console 3, as best shown in FIG. 2. Typically, the electronic game controller 4 also comprises a random access memory (RAM) associated with the central processing unit, the RAM being used to store programme instructions and transient data related to the operation of the electronic game controller and hence the gaming machine 1. The RAM contains a body of program instructions for implementing a game on the gaming machine 1, as discussed in more detail below. The central processing unit or processor may also be operatively associated with a further storage device, such as a hard disk drive, which is used for long-term storage of program components and data relating to the electronic game controller 4 and/or the gaming machine 1, including a database for game performance data, as well as information gathered from users. It is also appreciated that a person skilled in the art would readily understand the location and use of the electronic game controller 4 in the gaming machine 1.

The electronic game controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic game controller 4, which then determines whether the minimum bet level has been reached. If so, the electronic game controller 4 will permits play of the game on the gaming machine 1. If not, the electronic game controller 4 will send a signal to the display 7 to show a message requesting further value to be added to the gaming machine 1.

Figure 3:
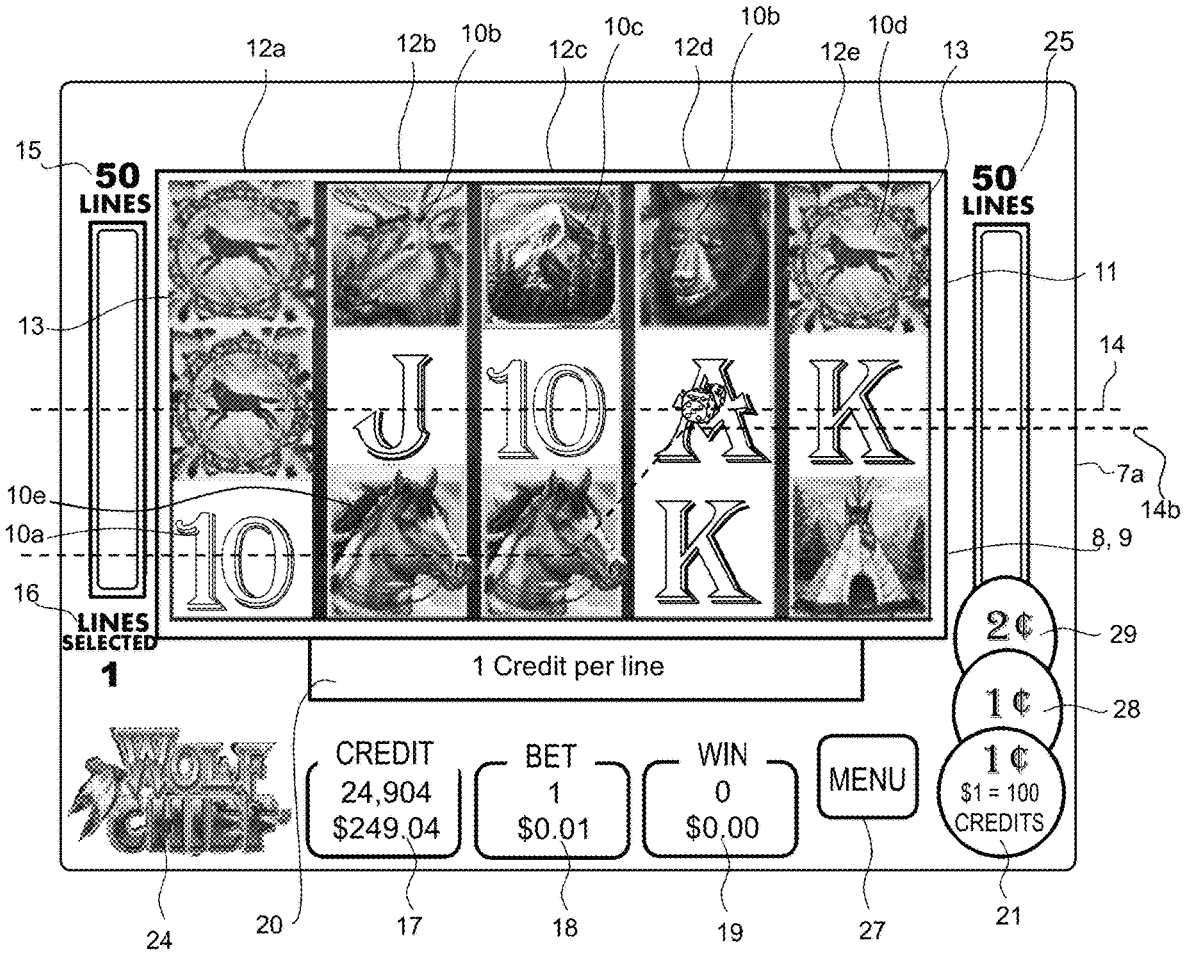
FIG. 3 is a simulated screen shot of a base game shown on a display of the gaming machine of FIG. 1.

The electronic game controller 4 is programmed to provide a game in the form of a base game 8 and a feature game 9 (as best shown in FIG. 3) on a lower playing area 7*a* of the display 7 of the gaming machine 1 for play by a player. An upper display area 7*b* (not shown) is reserved for showing artwork associated with the game(s) that are available for play on the gaming machine and/or other game information. The base game 8 has game symbols 10 arranged into an array 11 in the form of five columns or "reels" 12. The reels 12 give the visual appearance of rotating, typically by having the game symbols 10 move in a downward linear path along the length of each reel 12. While the array 11 is arranged with five reels 12 and three rows as per the industry standard, it will be appreciated by one skilled in the art that other types of arrays could be used, such as 3×3, 4×3, 5×5, 4×4, etc, including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic game controller 4 will transmit signals to the display screen 7 to cause the base game 8 and feature game 9 to be played on the lower playing area 7*a*, including showing the game symbols 10, array 11 and other visible elements of the games.

The array 11 of the base game 8 defines predetermined game or symbol positions 13, in which the game symbols 10 appear. The symbol positions 13 are not visually marked by boundary lines and simply provide an area for the game symbols 10 to appear. However, it will be appreciated that in other embodiments, the symbol positions 13 are defined by visible boundary lines (to define "squares" or game positions) or other markings to define each respective area of the symbol positions.

The array 11 is arranged so that a player can select one or more predetermined "pay lines" 14 defined around the array, which correspond to combinations of the symbol or game positions 13. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 result in the award of prizes to the player.

The game symbols 10 can include a mixture of picture symbols (such as animal symbols or playing card symbols), word symbols, scatter symbols, substitute or wild card symbols and trigger symbols to trigger the feature game 9. Those skilled in the art will readily understand that a substitute symbol is able to act as any other game symbol, and hence is also known as a "wild card" symbol. Likewise, those skilled in the art will readily understand that a scatter symbol is a symbol that triggers a game event or confers an award without having to appear on a player-selected pay line 14. Similarly, a trigger symbol is a symbol that triggers a game event or confers an award, where the trigger symbol may or may not have to appear in combination and may or may not have to appear on the same player-selected pay line 14. In a typical game shown in FIG. 3, the game symbols 10 include playing card symbols 10*a*, animal-themed symbols 10*b*, item-themed symbols 10*c*, scatter symbols in the form of "wolf banner" symbols 10*d* and a substitute or wild card symbol in the form of horse symbols 10*e*. In one embodiment shown in FIG. 4, the game symbols 10 generally involve a space theme so that the game symbols 10 include space-themed picture symbols 10*f*, substitute Alien symbol 10*e* and scatter Sun symbol 10*g*. The electronic game controller 4 randomly determines the appearance of the game symbols 10 on the array 11.

The video screen 7 also displays other standard game information in the lower playing area 7*a*, including the number of pay lines available 15, the number of player-selected pay lines 16, the amount of player credits 17, the amount of the current bet wagered by the player 18, the amount of wins by the player 19, a message area 20, a current denomination button 21 indicating the currently selected base bet denomination and the name 24 of the base game 8, Wolf Chief™, as best shown in FIG. 3. In other embodiments, the video screen 7 displays a menu button 27 for bringing up a menu screen (typically explaining the game rules and showing the available pay lines 14) and/or jackpot information relating to the based game 8 and feature game 9 that are awarded by the electronic gaming machine 1. This jackpot information is typically displayed in the upper display area and can comprise, in descending order of monetary value, a grand jackpot, major jackpot, minor jackpot and midi jackpot.

In the base game 8, the player initially makes a bet using vending slots 5 to initiate play of the gaming machine 1 by building up credit to play the base game 8 on the gaming machine. For example, the player can bet or wager monetary amounts equivalent to a particular amount of credits, depending on the bet denomination selected for the base game. Also, the player can make any additional side bets or ante-bets during play of the base game 8 once the base game has commenced to access additional features in the base game, such as increasing the number of winning combinations in the base game.

Typically, gaming machines offer a number of preset bet options that the player can make, and these bet options can vary depending on the game or games offered on the gaming machine. For example, a game on a gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc.

The gaming machine 1 also has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the gaming machine has not yet been played or has been started up, the default bet denomination is initially selected by the electronic game controller 4. The default bet denomination can be randomly selected or chosen according to a predetermined order. Usually, the electronic game controller 4 will select the bet denomination with the lowest value that is available for the base game 8, which would be the 1¢ bet denomination for this embodiment. The player may change the bet denomination at any time in the base game 8 by touching the denomination button 21 before or after the reels 12 have spun. In this embodiment, touching the denomination button will bring denomination images 28, 29 that the player may select to quickly change the bet denomination between plays of the game 8.

Once the player has commenced play of the game 8 by making an appropriate bet via the vending slots 5, the electronic game controller 4 then commences a play of the base game 8 by sending a signal to the display 7 to cause the reels 12 to appear to visibly rotate or "spin" in a linear path, typically in a downward vertical direction, and randomly display the game symbols 10 in each game position for each play of the array 11 for the base game 8. After the reels 12 stop spinning (and thus ends the spin or play of the base game 8), the electronic game controller 4 determines whether there are any predetermined winning combinations of the game symbols 10 appearing in any player-selected pay lines 14, such as a two of a kind, three of a kind, four of a kind or five of a kind for all the game symbols 10 and other combinations of a "full house", "straight" or "flush" for the playing card game symbols 10*a*. It will be appreciated that other winning combinations of game symbols 10 can also be provided. If so, the gaming machine 1 enters a winning game state and awards a prize according to the displayed predetermined winning combination.

The electronic game controller 4 also determines whether the feature game 9 should be activated, based on a predetermined feature game trigger event, such as the appearance of a number of trigger symbols appearing in a play or spin of the base game 8. In one embodiment, the feature game trigger event is the appearance of three scatter symbols 10*d*. The scatter symbols 10*d* need not appear on the same pay line 14, but can appear on any of the player-selected pay lines, as best shown in FIG. 3. In response to the trigger event, the electronic game controller 4 then transmits a signal to the video screen 7 to cause a feature game 9 to appear on the video screen 7.

The feature game 9 as shown in FIG. 3 is an enhanced version of the base game 8. It uses the same game symbols 10 as the base game 8, as well as the same array 11, reels 12, game positions 13 and player-selectable pay lines 14 on the video screen 7. In the feature game 9, ten free plays or spins of the feature game are awarded to the player without having to make an additional bet or wager. It will be understood by those skilled in the art that a free play or spin involves a play of the game without requiring any bet to be made by the player, and that any number of free spins can be chosen for the feature game 9. In addition, it will be appreciated that in the art free spins are commonly referred to as "free games". The number of free games remaining in the feature game 9 is indicated by a counter 31. Typically, the prizes awarded for the same winning combinations of game symbols in the feature game 9 are of higher value than the prizes awarded in the base game 8.

The feature game 9 operates in a similar manner to the base game 8, where the reels 12 visibly rotate and display randomly selected game symbols 10 in each game position 13. Predetermined winning combinations of randomly selected game symbols 10 in the array of the feature game 9 also result in the award of prizes to the player, usually of an enhanced value compared to the prizes awarded in the base game 8.

Figure 4:
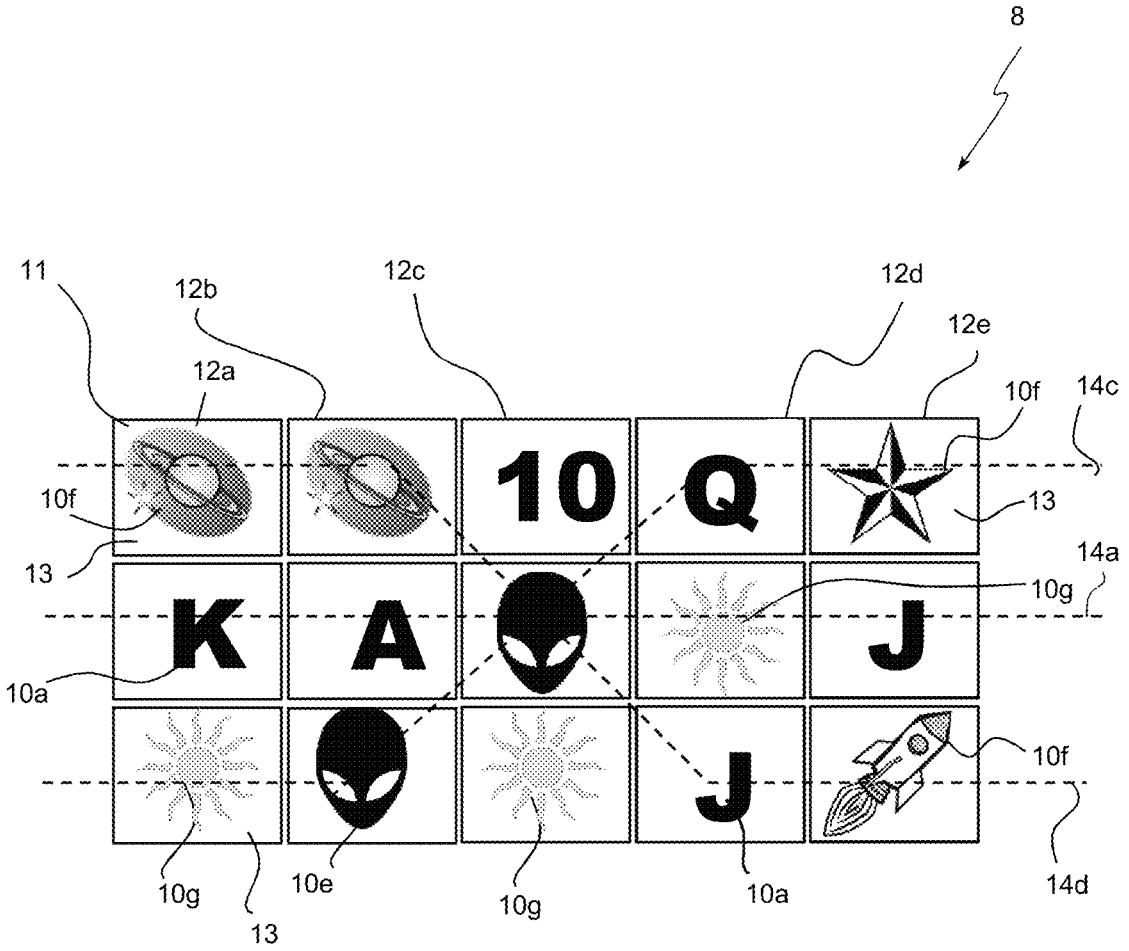
FIGS. 4 and 5 are partial simulated screen shots of another base game shown on the display of the gaming machine of FIG. 1.

In the embodiment of FIG. 4, the various visual elements of the base game 8, such as standard game information like the number of pay lines available 15, the number of player-selected pay lines 16, the amount of player credits 17, the amount of the current bet wagered by the player 18, message area 20 and current denomination button 21, have been removed for clarity purposes. The base game 8 also uses three scatter Sun symbols 10*g* as a feature game trigger event to award a feature game (not shown) similar to the base game, where five free games are played and enhanced prizes are won for the same winning combinations of game symbols 10*a*, 10*f* that usually appear in the base game 8. Also, the appearance of three or more scatter Sun symbols 10*g* retriggers the feature game to award another five free games.

Figure 5:
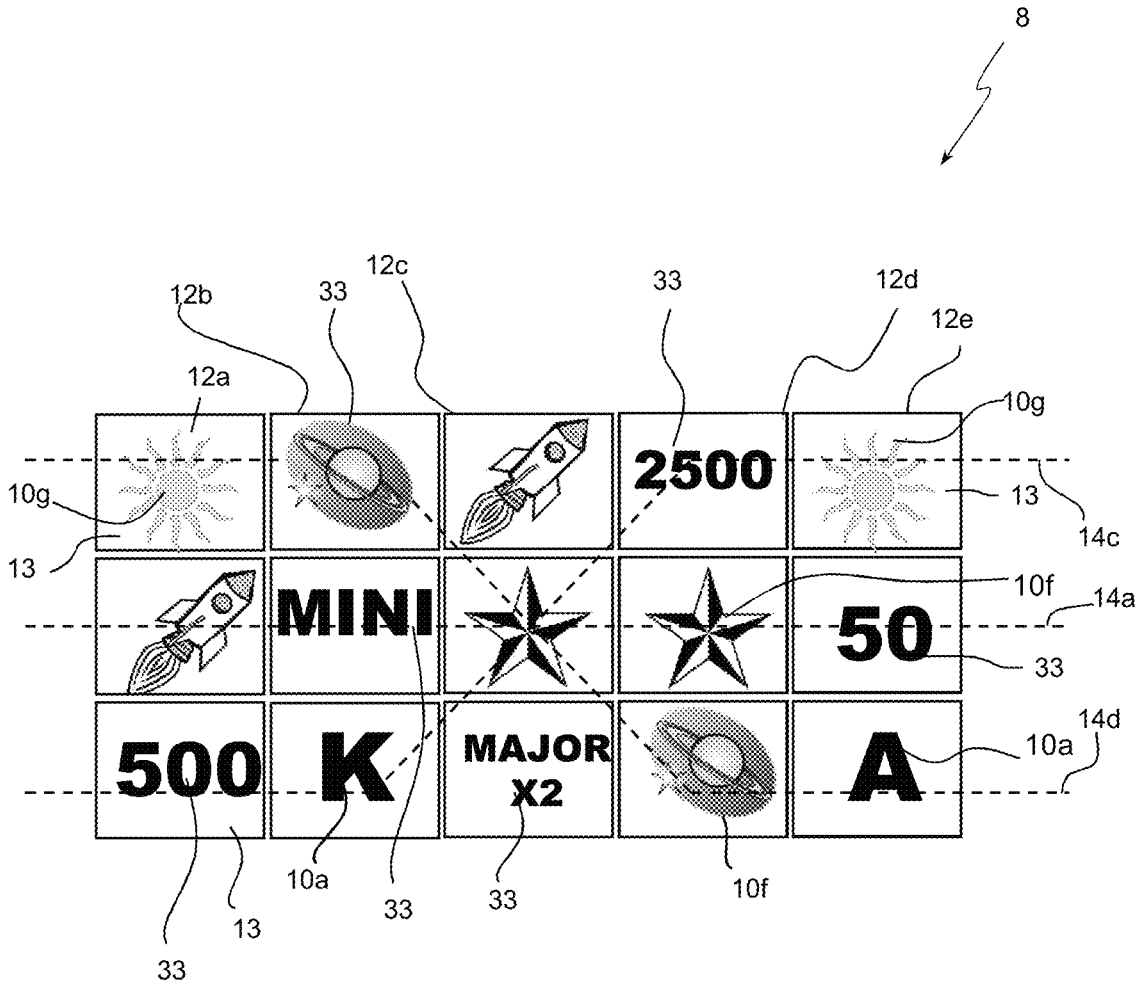

The base game 8 of FIG. 4 may also show one or more bonus symbols 33 in the game positions 13 of the reels 12*a* to 12*e*, as best shown in FIG. 5. These bonus symbols 33 are associated with a variety of bonus value awards, including monetary credits (such as 50 credits, 500 credits and 2,500 credits), bonus prizes (such as Mini and Minor bonus prizes) and jackpots (such as Major and Double Major jackpots). The bonus prizes are simply credit prizes of higher worth while the jackpots are progressive jackpots. The appearance of five bonus symbols 33 in the game positions 13 of the reels 12*a* to 12*e* (as best shown in FIG. 5) is another feature game trigger event for triggering another feature game 35 called "Penny Pusher", as best shown in FIGS. 6 to 14.

Figure 6:
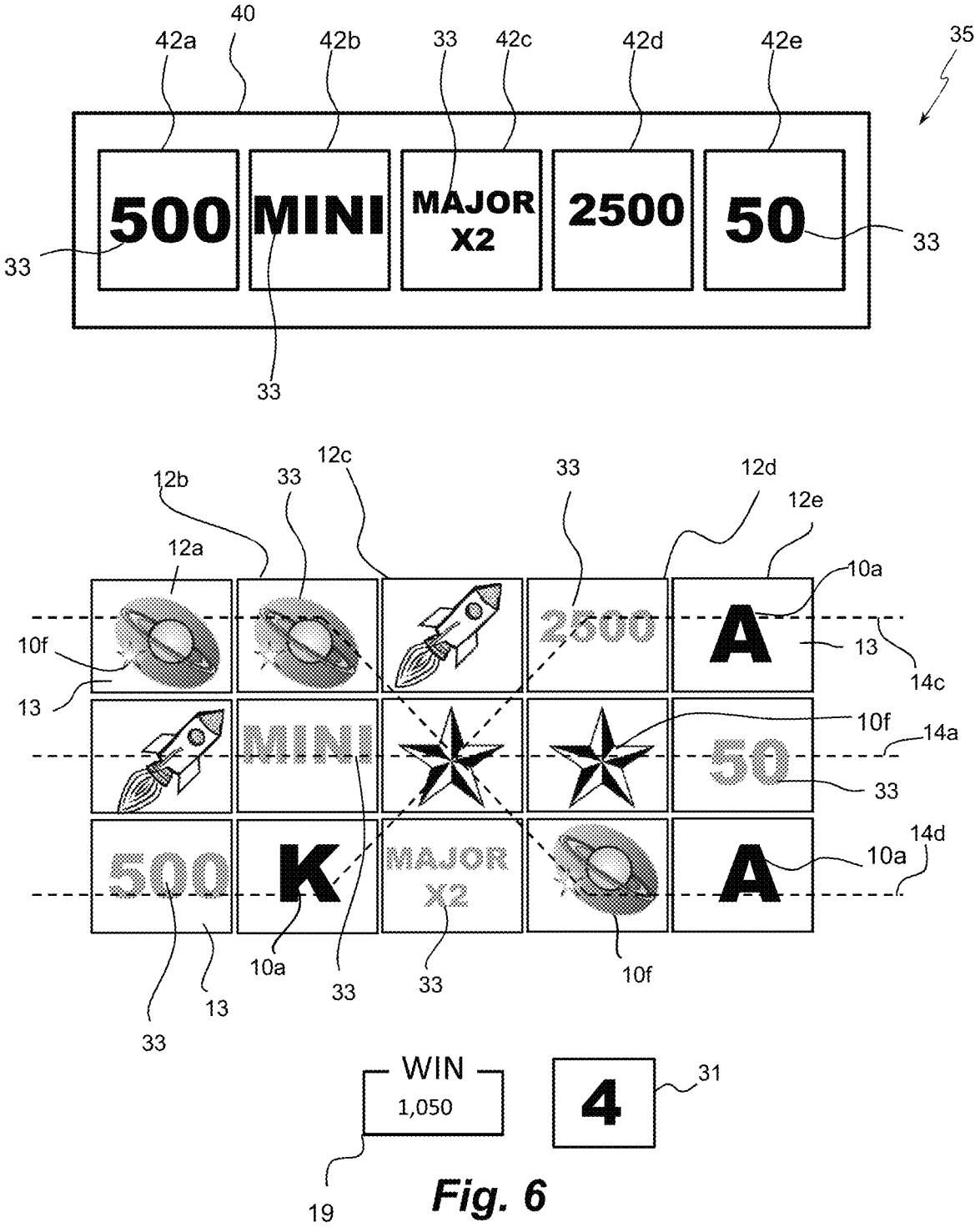
FIGS. 6 to 14 are partial simulated screen shots of a feature game shown on the display of the gaming machine of FIG. 1.

In FIG. 6, the Penny Pusher feature game 35 commences by the bonus symbols 33 greying out and then moving from the reels 12*a* to 12*e* to a separate array 40 located above the array 11 of the reels 12*a* to 12*e*. In some embodiments, the bonus symbols 33 grey out or become transparent and a duplicate of each bonus symbol 33 appears in the array 40. In other embodiments, the bonus symbols 33 move to the array 40 without greying out and leaving empty game positions 13.

In some embodiments, the array 40 is located on another video display above the video screen 7, such as a top display screen or a topper having a video screen. In the Penny Pusher feature game 35, initially four free games are awarded to the player as indicated by the free games counter 31 located adjacent a win meter 19 indicating the amount of wins by the player.

The array 40 has array positions 42*a* to 42*e* and the bonus symbols 33 are initially placed in the array positions corresponding to their game positions 13 in the reels 12*a* to 12*e*. For example, the 500 bonus symbol 33 that appeared in the reel 12*a* is located in the array position 42*a* of the array 40 above the reel 12*a*. Similarly, the MINI bonus symbol 33 that appeared in the reel 12*b* is located in the array position 42*b* of the array 40 above the reel 12*b*. In other embodiments, the bonus symbols 33 are randomly located in the array positions 42 of the array 40. In further embodiments, where two or more bonus symbols 33 appeared in the same reel 12, then the bonus symbols 33 are arranged in a predetermined order in the array 40, such as the bonus symbol 33 closest to the array appears in the array position 42 corresponding to the reel position 13 with the other bonus symbols 33 occupying successive or adjacent array positions 42.

Figure 7:
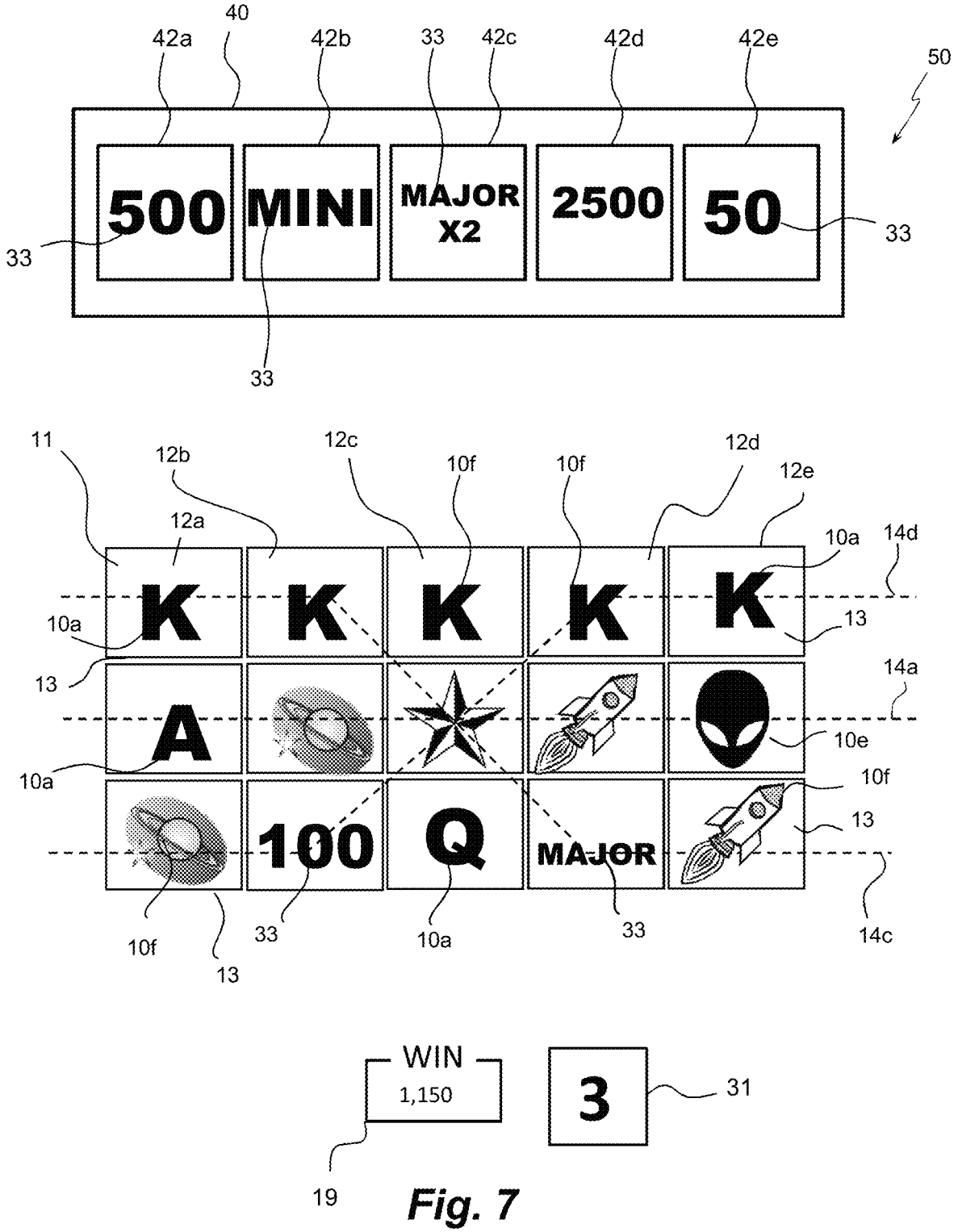
Figure 8:
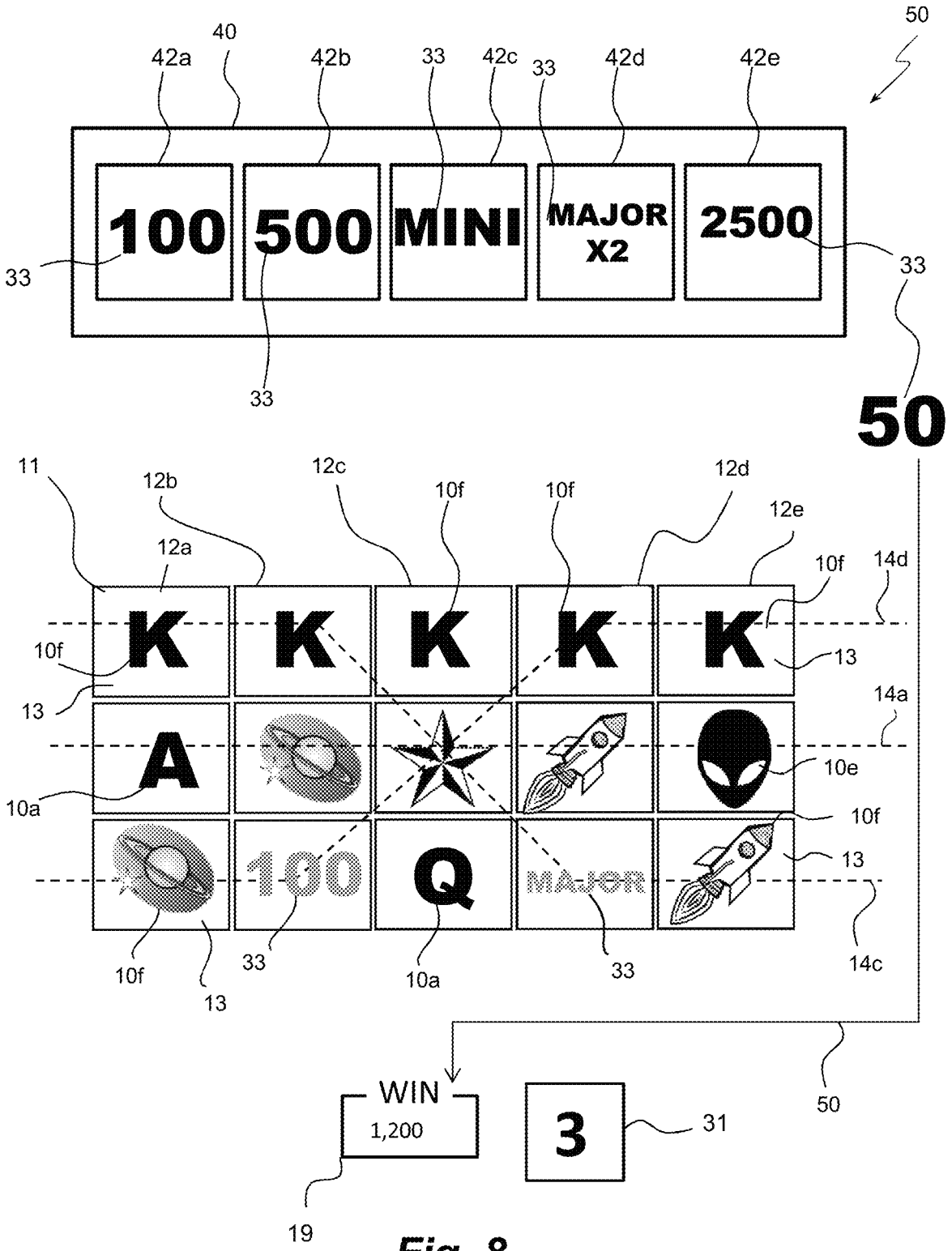
Figure 9:
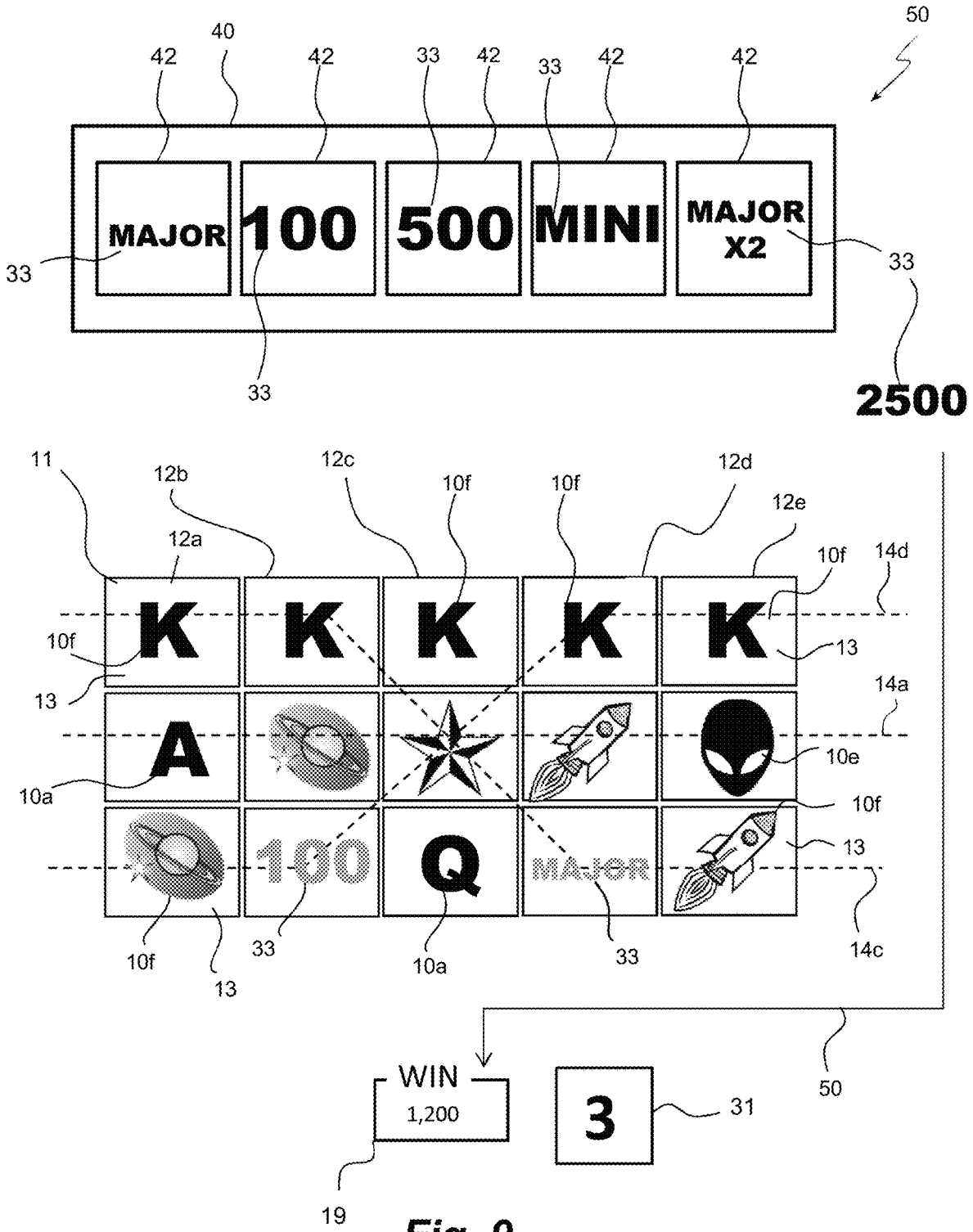

The feature game 9 then commences playing the free games and result of the first free spin is shown in FIG. 7, where a winning combination of five King symbols 10*a* results in 100 credits being awarded to the player and increasing the win meter 19 from 1,050 credits to 1,150 credits. In addition, a 100 credit bonus symbol and a MAJOR bonus symbol 33 appear in reels 12*b* and 12*d*, respectively. These bonus symbols 33 then grey out and move to the array 40 sequentially or one after the other, as best shown in FIGS. 8 and 9. In FIG. 8, the nearest bonus symbol 33 to the left hand side of the reel array 11, being the 100 credit bonus symbol 33, moves first to the left hand side of the array 40 to fill the "entry" array position 42*a*. This causes the bonus symbols 33 already present in the array 40 to move over to the right by one position, the 50 credit bonus symbol 33 leaving the end or exit array position 42*e* and out of the array 40. The 50 credit bonus symbol 33 then moves to the win meter 19 as indicated by arrow 50. The movement of the 50 credit bonus symbol 33 can visually shown by "falling off" the array 40 and swooping down to the win meter 19 with accompanying lights, special effects and/or sounds. In other embodiments, the 50 credit bonus symbol 33 can simply slide to the win meter 19, animate as it moves or any other visual display. Once the 50 credit bonus symbol 33 reaches the win meter 19, it disappears and the amount of the win meter increases by the value associated with the bonus symbol, which is by 50 credits. The increase in the win meter 19 is indicated aurally, but in other embodiments a visual increase in the amount may be shown. The amount shown in the win meter 19 is now 1,200 credits, as shown in FIG. 8.

The next bonus symbol 33 in the free spin, being the MAJOR bonus symbol, moves to the entry array position 42*a* and again causes the bonus symbols 33 to move along the array positions, as best shown in FIG. 9. This time, the 2,500 credit bonus symbol 33 is "pushed" out of the array 40 from the exit array position 42*e*, where it "falls off" and swoops down to the win meter 19 and increases its amount to 3,700 credits, as shown in FIG. 10.

Figure 10:
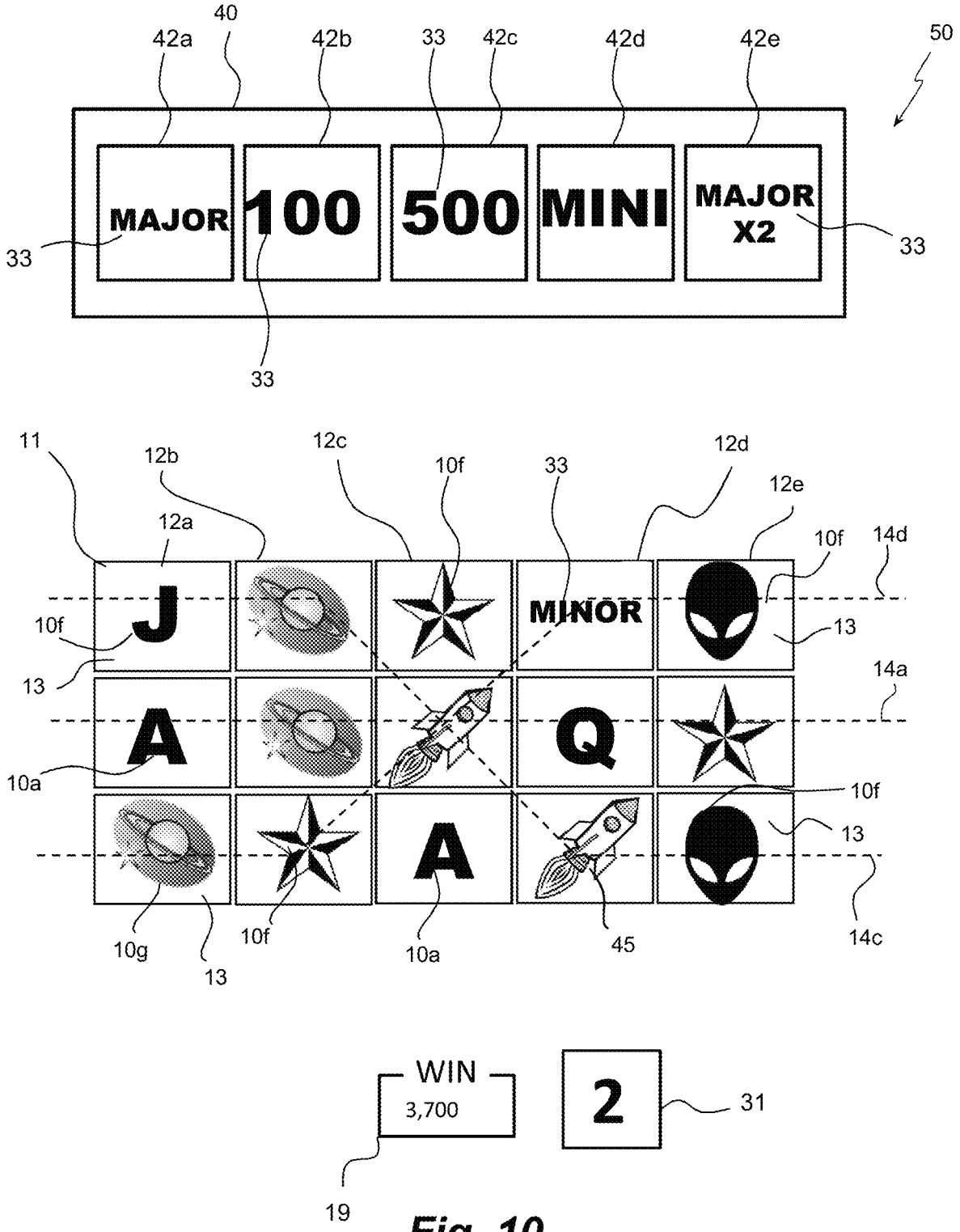
Figure 11:
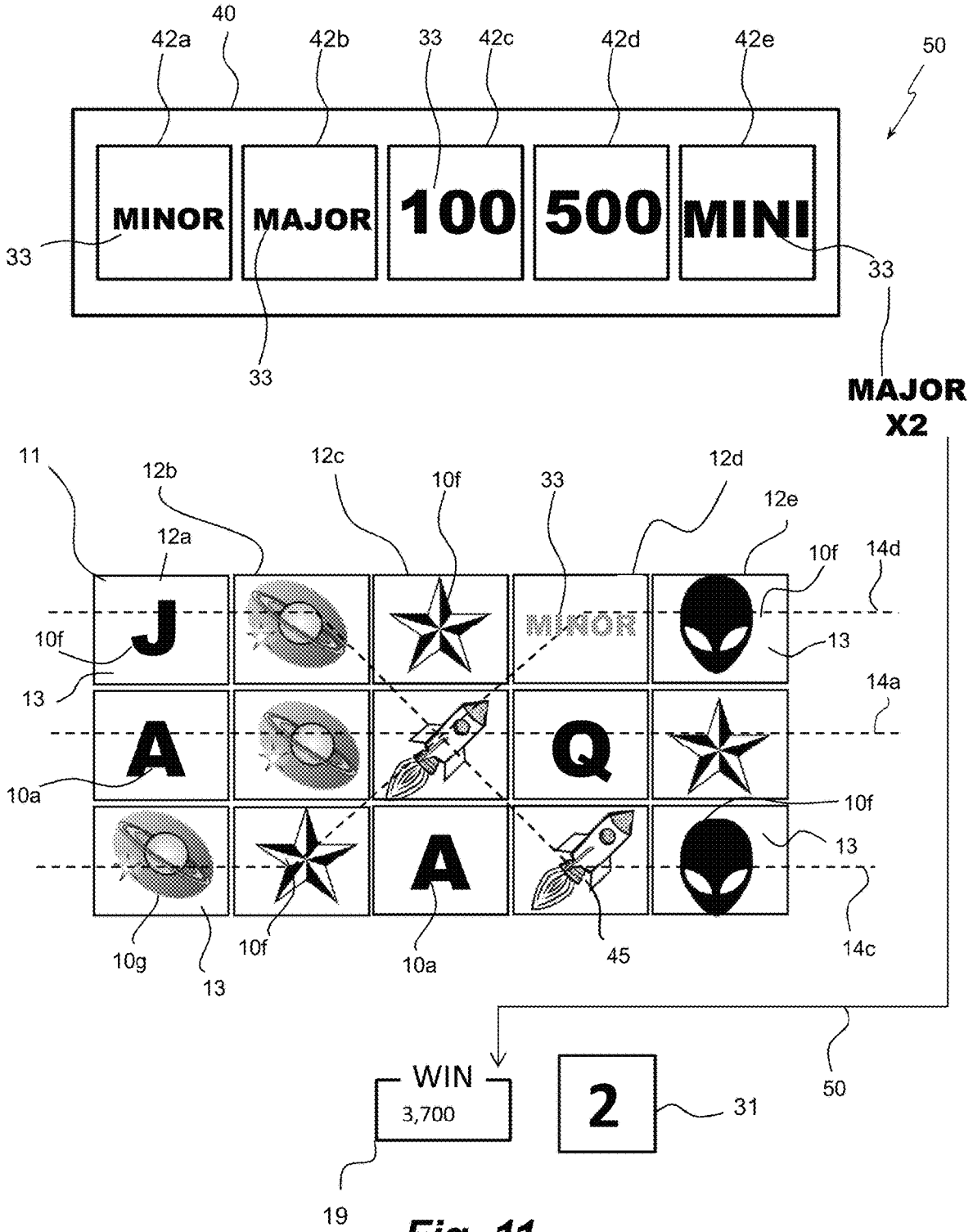

At the end of the next free spin shown in FIG. 10, a MINOR bonus symbol 33 has appeared in reel 12*d* and the above process repeats. As shown in FIG. 11, the MINOR bonus symbol 33 greys out in the reel 12*d* and moves to the entry array position 42*a* of the array 40, pushing out the MAJOR ×2 bonus symbol 33 from the exit array position 42*e*. The MAJOR ×2 bonus symbol 33 then falls off and swoops down to the win meter 19 to increase the displayed amount in credits equivalent to double the Major progressive jackpot.

Figure 12:
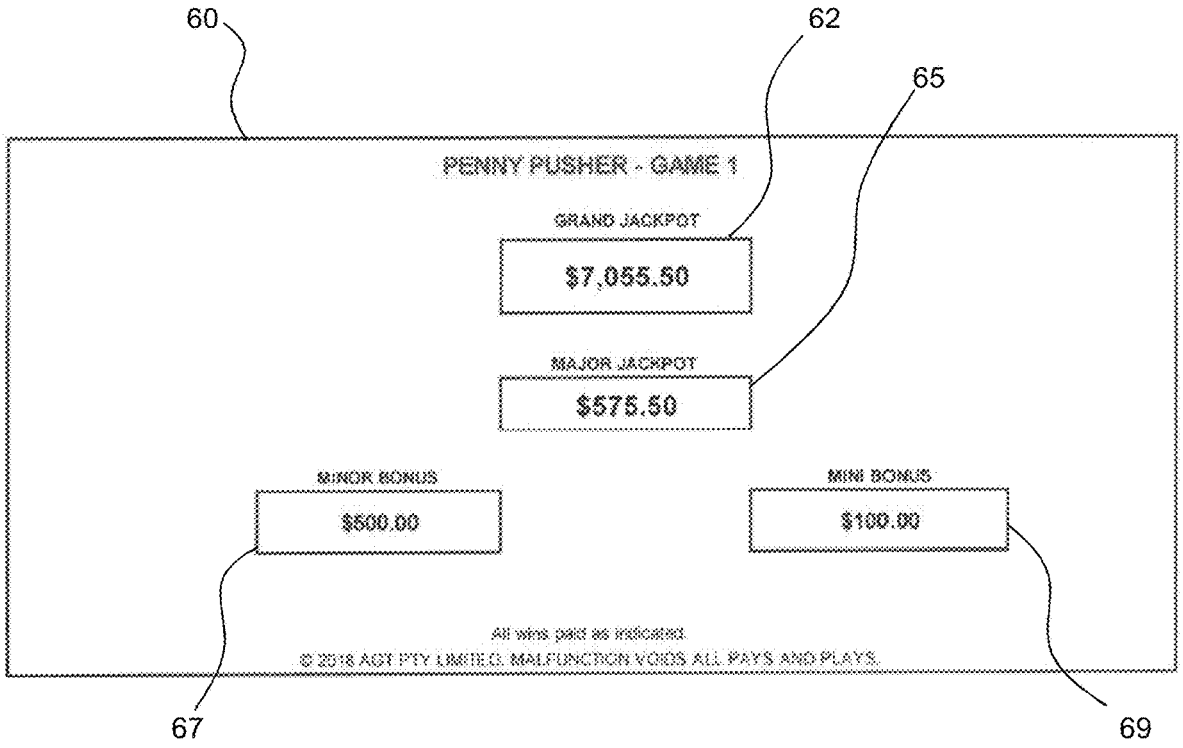

Referring to FIG. 12, an illustrative jackpot information screen 60 is shown indicating the progressive Grand jackpot 62 and Major jackpot 65, and the monetary prizes Minor bonus 67 and Mini bonus 69. The jackpot information screen 60 may be displayed in an upper video screen, a topper display or otherwise be available through the menu button for display on the video screen 7. The Major jackpot 65 is presently showing an amount of $575.50 and assuming that the player made a bet of 10¢, then the win meter 19 will increase by 11,510 credits (being 2×5755 credits where 1 credit is 10¢) to 15,210 credits, as shown in FIG. 13.

Figure 13:
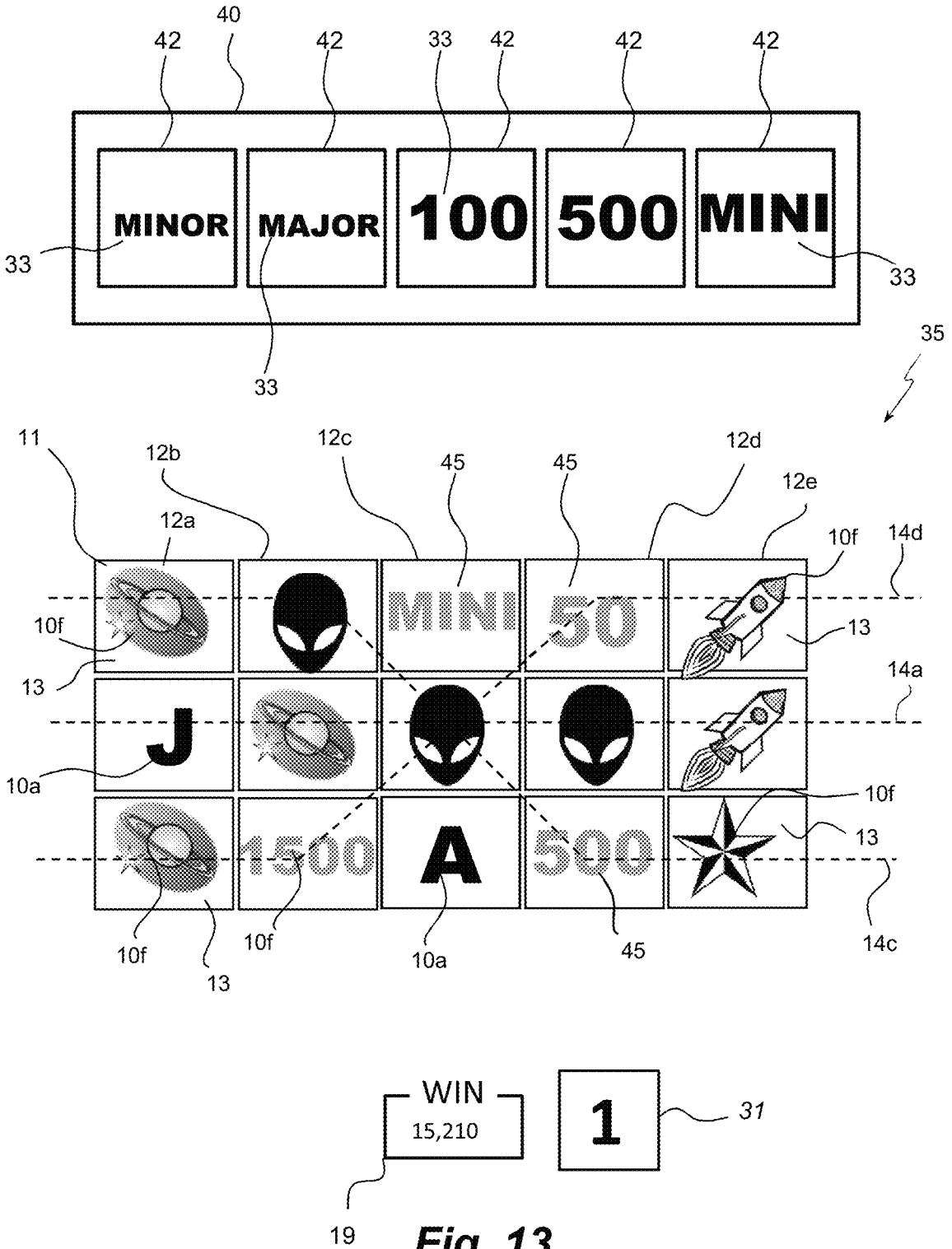
Figure 14:
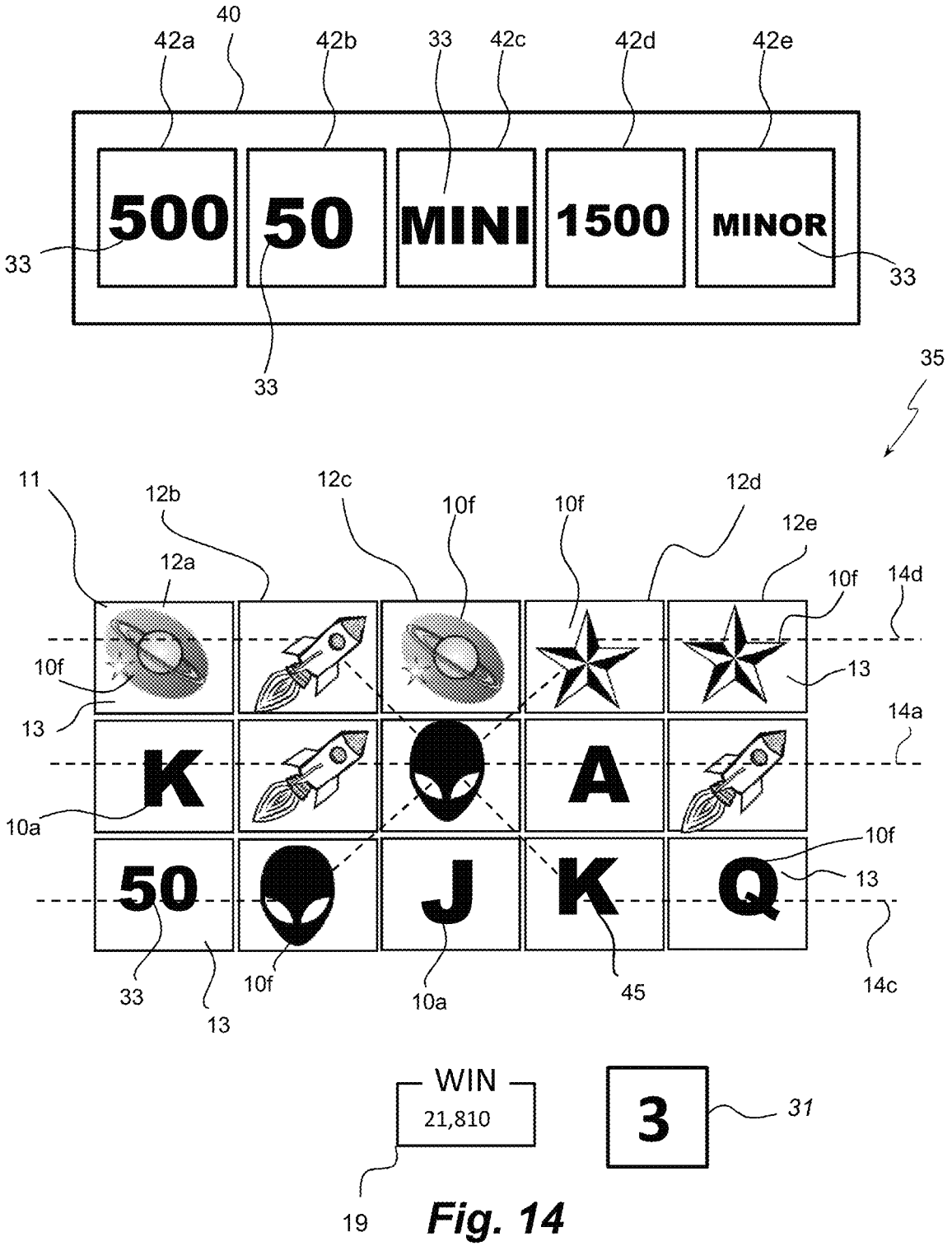

FIG. 13 shows the end of the third free spin, where four more bonus symbols 33 have appeared in reels 12*b*, 12*c* and 12*d*. In this case the appearance of four or five bonus symbols 33 in a spin causes the award of three more free spins. The four bonus symbols 33 are also greyed out and moved sequentially to the array 40, pushing out the MINI, 500, 100 and MAJOR bonus symbols 33 out of the exit array position 42*e* and to the win meter 19. Hence, the win meter 19 again increases by the cumulative amount of 6,600 credits, being the sum of 100 credits, 500 credits, 1,000 credits (the Mini bonus prize of $100 converted to credits) and 5,000 credits (the Major progressive jackpot amount reset to $500 since the double Major progressive jackpot was won in an earlier free spin converted into credits). Thus, the win meter 19 displays the amount of 21,810 credits as shown in FIG. 14, which shows the end of the next free spin, where the counter 31 has added the three free games and a 50 bonus symbol 33 has appeared in reel 12*a*. As noted above, as the 50 bonus symbol 33 appears in the top row of the reel 12*d* and the 500 bonus symbol 33 appears in the bottom row of the reel 12*d* in FIG. 13, the 50 bonus symbol 33 precedes the 500 bonus symbol 33 in the array 40 in FIG. 14.

In some embodiments, where five bonus symbols 33 appear in the reels 12*a* to 12*e* of the feature game 35 to award additional free games, these bonus symbols 33 are transferred to the array 40 by moving to the array position 42*a* to 42*e* corresponding to their game position 13 in the reels 12*a* to 12*e*, instead of sequentially entering the array 40 through the entry array position 42*a*.

It can thus be seen that the array 40 defines a track or path of array positions 42*a* to 42*e* that each bonus symbol 33 follows and then is ejected or pushed out of the array 40 to increment the win meter 19 by its associated bonus value award as bonus symbols 33 are added to the array in subsequent spins of the feature game 35. Consequently, a player is able to see what additional prizes (credits, bonuses or jackpots) that can be won by moving the bonus symbols along the track of the array 40 during play of the feature game 35. This provides an entertaining and more efficient way of awarding prizes to the player while providing variety in game play. It also provides a way of providing more game symbols to the screen 7 that is normally available in a standard feature game by retaining the bonus symbols 33 on the game playing area 7*a* in subsequent spins of the feature game 35.

It will be appreciated that while some of the bonus symbols 33 directly indicate the associated bonus value award, such as the monetary credit symbols 50, 100, 500, 2,500, etc. in further embodiments, the bonus symbols 33 may be picture or word based and only indirectly indicate their associated bonus value award.

In some embodiments, the trigger event for the feature game 35 is not be the appearance of five bonus symbols 33 anywhere on the reels 12*a* to 12*e*, but instead may use a combination of the scatter Sun symbols 10*g*. In this case, prior to commencement of the feature game 35, bonus symbols 33 are randomly allocated to the array positions 42*a* to 42*e* of the array 40. In other embodiments, the trigger event for the feature game 35 is for a bonus symbol 33 to appear in each reel 12*a* to 12*e*.

In this embodiment, the Grand progressive jackpot 62 shown in FIG. 12 can only won be randomly during play of the base game 8 and not through any of the feature games 9, 35. Likewise, the Major progressive jackpot 65 and the Minor and Mini bonus prizes 67, 69 can only be won through the feature game 35.

As discussed above, the Grand and Major jackpots 62, 65 are progressive jackpots. A progressive jackpot prize takes a portion of each bet (typically a set percentage of each bet) made on the gaming machine and thus the amount of the progressive jackpot incrementally increases as more bets are made on the gaming machine 1. The progressive jackpot is typically awarded when a winning game combination associated with the jackpot occurs in the game played on the gaming machine. In many cases, progressive jackpots are associated with the least probable winning combination and are commonly the highest paying award of the gaming machine. In other cases, a separate trigger event can be used to award the progressive jackpot prize, such as a special jackpot symbol, a trigger event internally generated by the electronic game controller. Alternatively, or additionally, once a certain threshold is met, either a certain amount that has been bet on the gaming machine or the incremented amount of the progressive jackpot, a trigger event is activated in the electronic gaming machine to pay out the progressive jackpot prize. Progressive jackpot prizes also tend to be shared amongst multiple gaming machines so as to increase the amount of the progressive jackpot prize and hence increase player interest in playing one of the electronic gaming machines. In some gaming machines, more than one jackpot or progressive jackpot are offered by the gaming machine or gaming machines linked together.

In the described embodiment, different reel strips are used for the feature games 9 and 35. In the feature game 9, the reel strips omit the bonus symbols 33 as the Penny Pusher feature game 35 is not activated or triggered from the feature game 9 and so the bonus symbols 33 have no utility in the feature game 9. Likewise, in the feature game 35, the reel strips used do not have any scatter Sun symbols 10*g*, as these symbols are not used in this feature game. In some embodiments, the bonus symbols 33 could be used to trigger the feature game 35 from the feature game 9 in certain circumstances. Alternatively, the feature game 35 may use the scatter Sun symbols 10*g* to award a scatter prize.

It will also be appreciated that while the array 40 has been described as a linear track above the reels 12*a* to 12*e*, in some embodiments, the array 40 may take other shapes or appearances. For example, the array 40 could be displayed as an escalator or elevator that the bonus symbols 33 travel along before "falling off" to the win meter 19. Similarly, the array 40 could be displayed as a cannon, with the bonus symbols 33 being cannonballs "shot" towards a target, being the win meter 19. Other themes can include presenting the array 40 as a spiral staircase, maze, asteroid belt or seashell with the bonus symbols representing elements consistent with the theme chosen.

Hence, the embodiments of the present disclosure enable the gaming machine 1 to award additional prizes to those that can be obtained from standard combinations of game symbols 10 displayed in the array 11. This increases the probability of the player winning a prize and/or a prize of higher amounts than is ordinarily possible. By providing an array of bonus symbols for awarding additional prizes to the player that is added to as more bonus symbols appear during game play, the invention provides more interest to continue playing the game to the player and does so in a more entertaining manner. Thus, the embodiments permit additional prizes of potentially higher worth to be won more frequently in a more entertaining manner to the player.

It will be appreciated that one skilled in the art will recognise that the term "volatility" refers to the expected frequency of winning game events occurring and the corresponding amount paid for each winning game event in order to maintain the required payout level set for the gaming machine. Thus, the amount paid for each winning combination and the level of return to the player determines the "volatility" of the gaming machine. For example, a gaming machine with low volatility is configured to have a relatively high frequency of "wins", where each win has a relatively low value. Conversely, high volatility refers to a lower frequency of "wins" of correspondingly higher value. Throughout the specification, "volatility" is a reference to this characteristic of a gaming machine.

Figure 15:
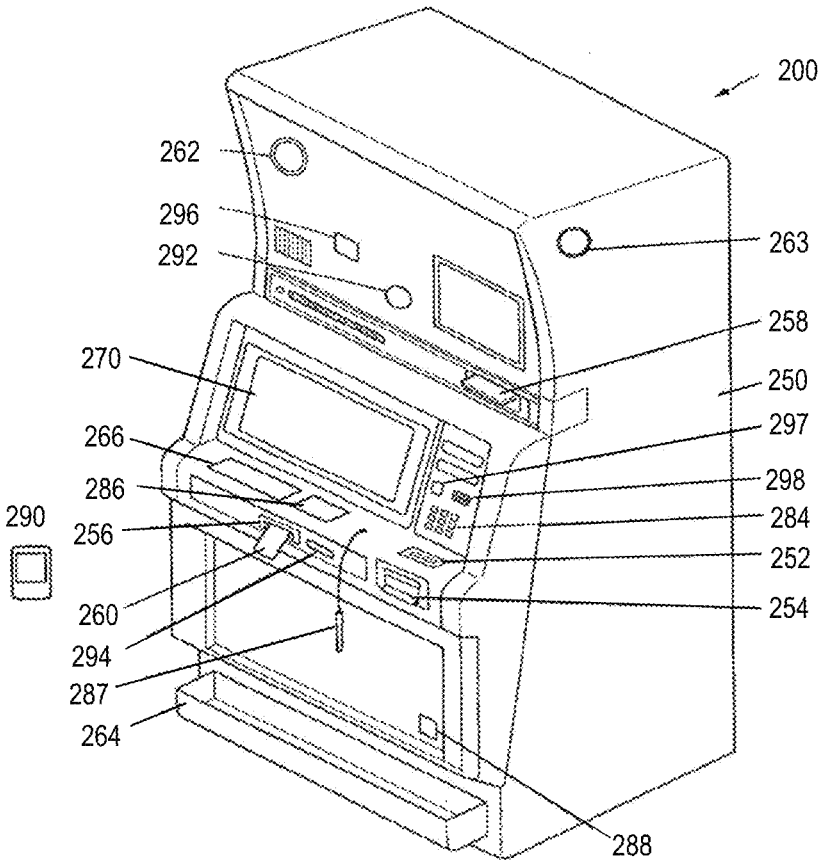
FIG. 15 is a perspective view of an electronic gaming machine according to yet another embodiment of the present disclosure.

Referring to FIG. 15, another embodiment is shown in the form of an electronic gaming machine 200. The electronic gaming machine 200 may include a housing or cabinet 250 and one or more value transfer mechanisms or devices, which may include a coin slot or acceptor 252, a paper currency or bill acceptor 254, a ticket reader/printer 256 and a card reader 258, which may be used to input value to the electronic gaming machine 200. A value transfer device may include any device that can accept value from a player. The topper (not shown) may be mounted to the top of the electronic gaming machine 200.

If provided on the electronic gaming machine 200, the ticket reader/printer 256 may be used to read and/or print or otherwise encode ticket vouchers 260. The ticket vouchers 260 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 260 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 260 could be printed with an optically readable material such as ink, or data on the ticket vouchers 260 could be magnetically encoded. The ticket reader/printer 256 may be provided with the ability to both read and print ticket vouchers 260, or it may be provided with the ability to only read or only print or encode ticket vouchers 260. In the latter case, for example, some of the electronic gaming machines 200 may have ticket printers 256 that may be used to print ticket vouchers 260, which could then be used by a player in other electronic gaming machines 200 that have ticket readers 256.

If provided, the card reader 258 may include any type of card reading device, such as a magnetic card reader or an optical card reader, and may be used to read data from a card offered by a player, such as a credit card or a player tracking card. If provided for player tracking purposes, the card reader 258 may be used to read data from, and/or write data to, player tracking cards that are capable of storing data representing the identity of a player, the identity of a casino, the player's gaming habits, etc.

The electronic gaming machine 200 may include one or more audio speakers 262, a coin payout tray 264, an input control panel 266, and a colour video display unit 270 for displaying images relating to the game or games provided by the electronic gaming machine 200. The audio speakers 262 may generate audio representing sounds such as the noise of spinning reels, a dealer's voice, music, announcements or any other audio related to a game. The input control panel 266 may be provided with a plurality of pushbuttons or touch-sensitive areas that may be pressed by a player to select games, make wagers, make gaming decisions, etc.

Figure 16:
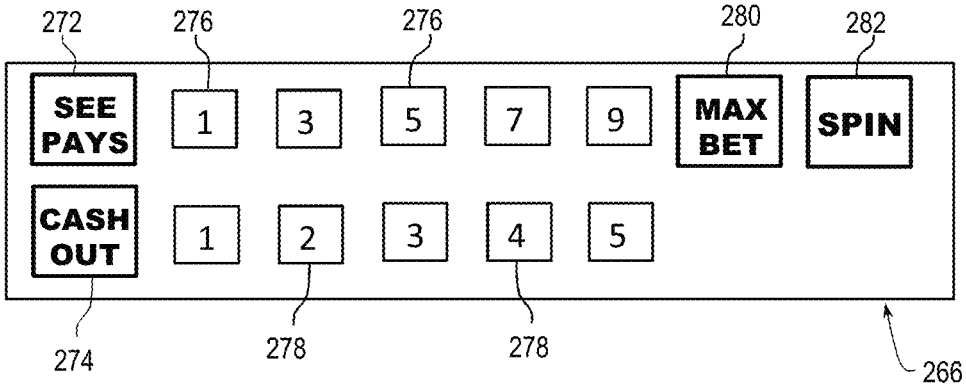
FIG. 16 is a schematic drawing of a control panel for the electronic gaming machine of FIG. 15.

FIG. 16 illustrates one possible embodiment of the control panel 266, which may be used where the electronic gaming machine 200 having a plurality of reels. The control panel 266 may include a "See Pays" button 272 that, when activated, causes the display unit 270 to generate one or more display screens showing the odds or payout information for the game or games provided by the electronic gaming machine 200. As used herein, the term "button" is intended to encompass any device that allows a player to make an input, such as an input device that must be depressed to make an input selection or a display area that a player may simply touch. The control panel 266 may include a "Cash Out" button 274 that may be activated when a player decides to terminate play on the electronic gaming machine 200, in which case the electronic gaming machine 200 may return value to the player, such as by returning a number of coins to the player via the payout tray 264.

The control panel 266 may be provided with a plurality of selection buttons 276, each of which allows the player to select a different number of pay lines prior to spinning the reels. For example, five buttons 276 may be provided, each of which may allow a player to select one, three, five, seven or nine pay lines.

The control panel 266 may also be provided with a plurality of selection buttons 278 each of which allows a player to specify a wager amount for each pay line selected. For example, the electronic gaming machine 200 may be provided with five selection buttons 278, each of which may allow a player to select 1¢, 2¢, 5¢, 10¢ and 20¢, to wager for each pay line selected. In that case, if a player were to activate one of the buttons 276 to select five pay lines and then activate one of the buttons 278 to select 5¢ per pay line to be wagered or bet, the total wager would be $0.25.

The control panel 266 may include a "Max Bet" button 280 to allow a player to make the maximum wager allowable for a game. In the above example, where up to nine pay lines were provided and up to 20¢ could be wagered for each pay line selected, the maximum wager would be $1.80 The control panel 266 may include a spin button 282 to allow the player to initiate spinning of the reels after a bet has been made.

In FIG. 16, a rectangle is shown around the buttons 272, 274, 276, 278, 280, 282. It should be understood that the rectangle simply designates, for ease of reference, an area in which the buttons 272, 274, 276, 278, 280, 282 may be located. Consequently, the term "control panel" should not be construed to imply that a panel or plate separate from the housing 250 of the electronic gaming machine 200 is required, and the term "control panel" may encompass a plurality or grouping of player activatable buttons.

Although one possible control panel 266 is described above, it should be understood that different buttons could be utilized in the control panel 266, and that the particular buttons used may depend on the game or games that could be played on the electronic gaming machine 200. Although the control panel 266 is shown to be separate from the display unit 270, it should be understood that the control panel 266 could be generated by the display unit 270. In that case, each of the buttons of the control panel 266 could be a coloured area generated by the display unit 270, and some type of mechanism may be associated with the display unit 270 to detect when each of the buttons was touched, such as a touch-sensitive screen.

As noted above, the electronic gaming machine 200 may include a mechanism by which the electronic gaming machine 200 may determine the identity of the player. In particular, the card reader 258 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 200 may also include equipment, such as a keypad 284, an input pad 286 (with optional stylus 287), a port (or antenna) 288 adapted to communicate via a wired or wireless link (infrared or radio frequency link, for example) to a mobile electronic device 290 (such as a personal digital assistant, smart phone or tablet), a camera 292, a scanner 294, a retinal (or iris) scanner 296, fingerprint scanner 297, and/or a microphone 298. The electronic gaming machine 200 may include any one of the devices 258, 284, 286, 288, 290, 292, 294, 296, 297, 298, or the electronic gaming machine 200 may include a combination of some or all of the devices 258, 284, 286, 287, 288, 290, 292, 294, 296, 297, 298.

In operation, a player may identify him or herself to the electronic gaming machine 200 by entering a unique numeric or alpha-numeric code using the key pad 284, for example. Alternatively, the player may use his or her finger or the stylus 287 to sign his or her signature on the input pad 286. As a further alternative, the player may sign his or her signature on the mobile electronic device 290, which signature is then converted to electronic data, and the data is then transferred via the port/antenna 288 to the electronic gaming machine 200. As yet another alternative, the player may sign his or her signature on a piece of paper that is then photographed using the camera 292 or scanned using the scanner 294 (or the bill acceptor 254) to convert the signature into electronic data. As an additional alternative, the player may place one of his or her fingers or his or her hand on the scanner 297, and the scanner 297 may generate an electronic data representation of the fingerprint on one or more of the player's fingers or an electronic data representation of the pattern of the entire hand. Alternatively, the camera 292 may be used to take a picture (live or still) of the player, the picture then being converted into electronic data. As a still further alternative, the player may place his or her eye up to the retinal (or iris) scanner 296, and the retinal (or iris) scanner 296 may generate an electronic data representation corresponding to the pattern of the retina (or iris) of the player. As yet another alternative, the player may speak into the microphone 298, and characteristics of the spoken words (or voiceprint) may be converted into an electronic data representation.

Figure 17:
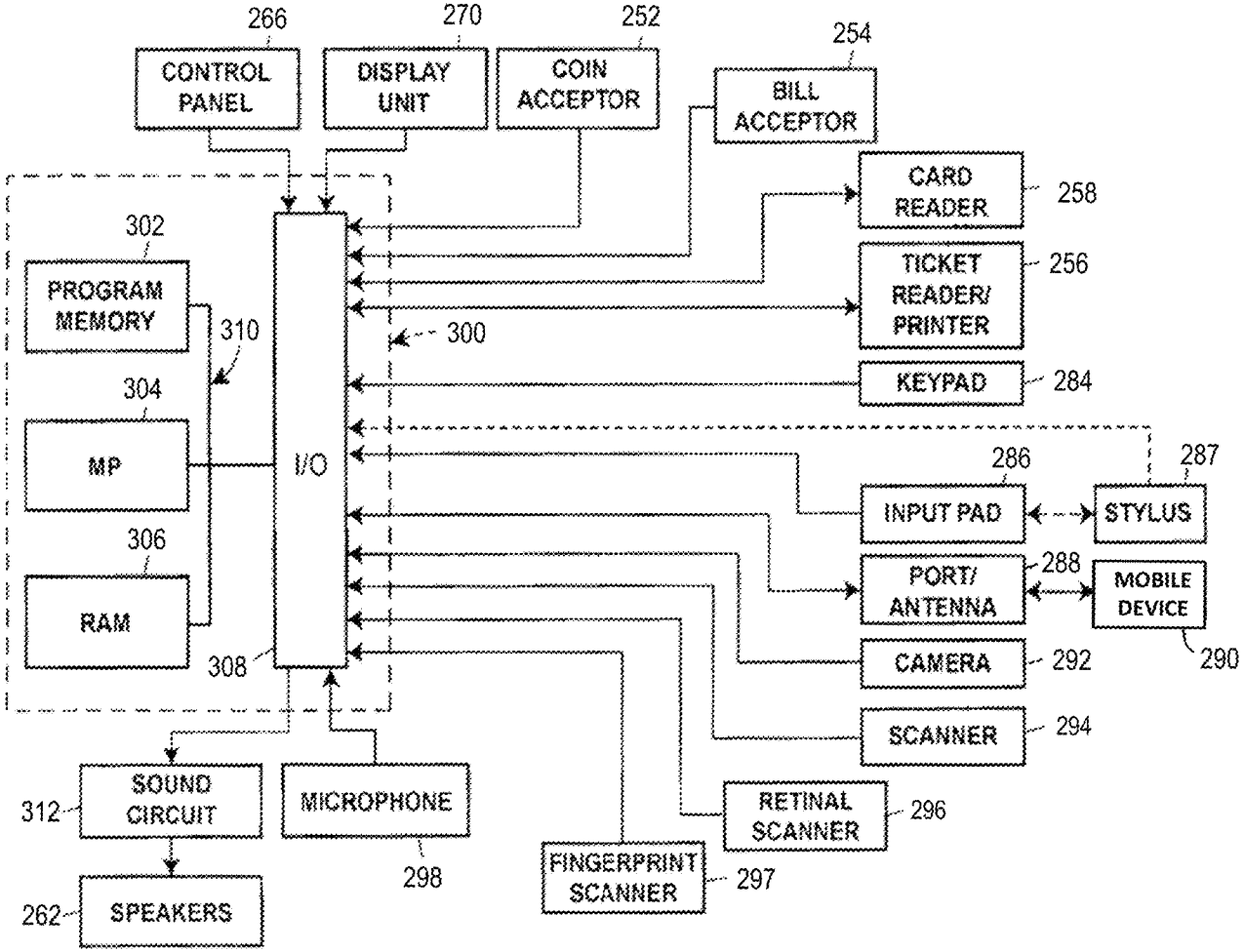
FIG. 17 is a block diagram of the electronic components of the electronic gaming machine of FIG. 15.

FIG. 17 is a block diagram of a number of components that may be incorporated in the electronic gaming machine 200. Referring to FIG. 17, the electronic gaming machine 200 may include a controller 300 that may comprise a program memory 302, a microcontroller or microprocessor (MP) 304, a random-access memory (RAM) 306 and an input/output (I/O) circuit 308, all of which may be interconnected via an address/data bus 310. It should be appreciated that although only one microprocessor 304 is shown, the controller 300 may include multiple microprocessors 304. Similarly, the memory of the controller 300 may include multiple RAMs 306 and multiple program memories 302. Although the I/O circuit 108 is shown as a single block, it should be appreciated that the I/O circuit 308 may include a number of different types of I/O circuits. The RAM(s) 304 and program memories 302 may be implemented as semiconductor memories, magnetically readable memories, and/or optically readable memories, for example.

FIG. 17 illustrates that the coin acceptor 252, the bill acceptor 254, the ticket reader/printer 256, the card reader 258, the control panel 266, the display unit 270, the keypad 284, the input pad 286 (and optionally the stylus 287), the port/antenna 288, the digital camera 292, the scanner 294, the retinal scanner 296, the fingerprint scanner 297 and the microphone 298 may be operatively coupled to the I/O circuit 308, each of those components being so coupled by either a unidirectional or bidirectional, single-line or multiple-line data link, which may depend on the design of the component that is used. The speaker(s) 262 may be operatively coupled to a sound circuit 312, that may comprise a voice- and sound-synthesis circuit or that may comprise a driver circuit. The sound-generating circuit 312 may be coupled to the I/O circuit 308.

As shown in FIG. 17, the components 252, 254, 256, 258, 266, 270, 284, 286, 287, 288, 292, 294, 296, 297, 298, 312 may be connected to the I/O circuit 308 via a respective direct line or conductor. Different connection schemes could be used. For example, one or more of the components shown in FIG. 16 may be connected to the I/O circuit 308 via a common bus or other data link that is shared by a number of components. Furthermore, some of the components may be directly connected to the microprocessor 304 without passing through the I/O circuit 308.

In some embodiments, at least one of the game symbols comprises a game enhancing symbol that confers a game enhancing element to the player. It is further preferred that the game enhancing element modifies the result of a play of the game, which can be any one or combination of the base game 8 and feature games 9, 35. The game enhancing elements may provide different types of effects or modifications of the game play result. In one embodiment, the game enhancing element comprises the award of one or more plays of the game that do not require a bet from the player. In other words, the game enhancing element awards a predetermined number of "free" games. In some embodiments, the game enhancing element comprises at least one or more a win multiplier, wild multipliers, bonus wilds, symbols that cause the award of additional free games, trigger symbols to retrigger the at least two second arrays, held columns, random wild symbols, stacked symbols, bonus symbols, new game symbols, reveal symbols, progressives, bonus credits, jackpot symbols, and one or more symbol replacements. A variety of game enhancing elements can be awarded by the game enhancing symbols, including:

- symbols that award a predetermined number of free plays of the game;
- win multiplier symbols that multiply the amount of any win from one of the predetermined winning combinations;
- "wild" symbols that cause the display of substitute symbols in randomly selected symbol positions;
- bonus symbols that awards a bonus prize, either as a monetary amount or as a bonus credit;
- wild multiplier symbols that cause the display of substitute symbols on the array 11 and multiplies the amount of any win from one of the predetermined winning combinations;
- bonus wild symbols that cause the display of substitute symbols on the array 11 and awards a bonus prize;
- symbols that cause the award of additional free plays of the game;
- symbols that cause one or more of the symbol positions to be held static (typically one or more reels 12*a* to 12*e*) and display substitute symbols on the array 11;
- symbols that cause the same game symbol to be stacked in a group of symbol positions, typically the group being one or more reels 12*a* to 12*e;*
- symbols that cause the display of new game symbols on the array 11;
- "reveal" symbols that cause a game symbol to reveal another game symbol; and
- "replacement" symbols that cause one or more game symbols to be replaced by other game symbols in the array 11.

These game enhancing symbols do not modify the function or value of the game symbols 10 that appear on the arrays 11, but instead confer bonus prizes, free games or change existing game symbols for other game symbols (such as replacing picture, royal card or symbols belonging to a reel with wild/substitute symbols). Where the function of game symbols 10 have been changed or the game symbols 10 are replaced, then this modification can take effect with the next play of the game instead of applying to the result of the spun array 11. In another embodiment, the game enhancing symbols may indicate the duration in which its game enhancing element is applied, such as a predetermined number of spins or a predetermined time period It will be appreciated that in other embodiments, game enhancing elements can also be awarded as a separate aspect of the games 8, 9 and 35. The game enhancing elements may further be awarded in addition or as an alternative to the enhanced prizes awarded based on winning combinations of game symbols 10 in the games 8, 9 and 35. In a further embodiment, the award of game enhancing elements can be done by way of a sixth reel or the appearance of game enhancing symbols in the reels 12*a* to 12*e*. The sixth reel in this case is simply added as an extension to the array 11 and spins either game enhancing symbols or "blank" symbols.

In some embodiments, the game enhancing symbols include "collector"-type game enhancing symbols which award points or tokens. The collection of points or tokens during the base game 8 and/or feature game 9, 35 leads to the trigger of additional prizes or game enhancing symbols, depending on the number of points or tokens that are collected. These additional prizes can include stand alone progressive jackpots, bonus prizes and super games, which are enhanced versions of free spins or games where there are greater pay outs or frequency of wins.

In other preferred forms, the game enhancing element can be an enhanced version of the array 11. The enhanced array may provide additional game enhancing symbols that include the award of points or an additional number of free spins of the array 11 (for example, retriggering 5 more free spins). The collection of points awarded by the enhanced array during free spins or game leads to the trigger of additional prizes or game enhancing symbols, depending on the number of points that are collected. These additional prizes can include stand alone progressive jackpots, bonus prizes and super games, which are enhanced versions of free spins or games where there are greater pay outs or frequency of wins. In addition, the enhanced array has a different visual representation to the array 11. In addition, the enhanced array may provide game enhancing symbols of greater value and/or frequency compared to the array 11.

Where the game enhancing element comprises the award of a jackpot prize, it can take the form of a standalone progressive jackpot, fixed jackpot, mystery jackpot, symbol driven jackpot and any combination thereof (i.e. a mixture of different types of jackpots). In some embodiments, the jackpots are limited to the feature game 9 and 35. In other embodiments, the jackpots are shared by all the games 8, 9 and 35. That is, the jackpots could be won through play of the games 8, 9 and 35.

The jackpot or bonus prizes may also be mystery jackpots rather than symbol driven jackpots. That is, none of the symbols in the game trigger the jackpot; hence the trigger event is a "mystery". The Grand jackpot in the described embodiments is awarded essentially as a mystery jackpot, being randomly awarded. By way of comparison, a standard jackpot is typically symbol driven in that a particular combination of symbols must occur in the game to trigger the standard jackpot.

The trigger event for the mystery jackpot can be one randomly generated by the electronic game controller 4 for each play of the games 8, 9 and 35. One way to implement the random determination of the trigger event is for the electronic game controller 4 to internally generate a random number and check if it is a predetermined number or within a predetermined range of numbers that will initiate the appearance of the trigger symbols. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur and award the progressive jackpot prize. It will be appreciated that this manner of determining the jackpot trigger event may also be used to determine whether the feature game 9 and/or 35 is triggered in the base game 8.

Progressive jackpots can be confined to the gaming machine 1 as so called "standalone" progressive jackpots. Alternatively, the jackpot is a wide area or an in-house linked progressive jackpot prize. In other embodiments, one or more the progressive jackpot prizes are configured to be part of a wide area or in-house linked progressive jackpot prize. In other words, the progressive jackpot prizes can be awarded on a group of networked gaming machines in a specified area or a group of specified gaming machines that are linked together for jackpot purposes (usually via a central jackpot controller). The jackpot prizes can also be shared with any other games offered on the same gaming machine 1 (as in multi-game gaming machines).

During play of the games 8, 9 and 35 the electronic game controller 4 will determine whether the trigger event for the jackpot has occurred. In response to the occurrence of the jackpot trigger event(s), the electronic game controller 4 transmits a signal to the video screen 7 to cause the jackpot(s) associated with the jackpot trigger event(s) to be awarded to the player. After the jackpot(s) are awarded, the amounts for any awarded jackpots are reset. The amounts of the jackpots that have been won can be reset either to a predetermined start amount or simply increment upwardly from zero where the won jackpot is a progressive jackpot.

In some embodiments, the in-game trigger event is determined at the end or during the play of the game; i.e. at the end or during a spin of the reels 12. In some embodiments, the in-game trigger event occurs in a preceding play of the game so that the result of the in-game trigger event takes place in a subsequent play of the game, typically the next play of the game after the preceding play but could include a later successive play of the game.

Furthermore, the embodiments of the present disclosure have been described as providing a standard 5×3 array for the base game 8 and the feature game 9. However, it will be appreciated that in other embodiments, the size and shape of the base game array 11 and feature game array may vary as desired. For example, the arrays 11 could take any number of different shapes, such as triangular, circular, square, hexagonal, hemi-spherical or other polygonal shapes. For example, the base game array 11 could comprise a circular array having three rings (equivalent to rows) like a bullseye target segmented into five columns. The feature game array would then expand into additional rings surrounding the initial rings of the base game array 11. Alternatively, the arrays 11 could have an unequal number of rows or columns. For example, the reels 12*a*, 12*b* could have three rows, but the reels 12*c* to 12*e* could have four rows.

While the preferred embodiment has been described in relation to both a base game 8 and a feature game 9, 35, those skilled in the art will appreciate that the use of bonus symbols 33 and array 40 can readily be applied to a base game alone or a feature game alone.

In some embodiments, the number of Mini, Minor and Major bonus symbols act as multipliers for the Mini and Minor bonuses and the Major jackpot. That is, the number of Mini, Minor and Major bonus symbols multiplies the amount of the Mini and Minor bonuses and the Major jackpot won by the player at the conclusion of the feature game 35. In other words, each Mini, Minor and Major bonus symbol represents its own Mini and Minor bonuses and the Major jackpot that can be won multiple times.

In a further variation to the embodiments, each game or symbol position 13 comprises its own individual reel and three of the reels may be grouped into columns of reels. That is, each symbol position 13 has its own individual reel strip of game symbols.

In other embodiments, the gaming machine 1 also offers the player the opportunity to play in community games against other players in so-called tournament games, or even in player versus player games. This is typically implemented by electronically linking several gaming machines 1 in a group within a gaming venue. The player versus player or tournament game can be played simultaneously by the players or can be staggered, with some players playing at one time and some players playing at another time in the same game. In this situation, the player versus player or tournament game comprises the award of an additional bonus prize in addition to the jackpot prizes in the selected available jackpot set.

While the same game format is essentially used across the base game 8 and feature game 9, it will be appreciated that the game format may vary across the base and feature games, as well as between base games where more than one game is offered by the same electronic gaming machine 1. For example, one of the games 8 may be a wheel-type game or a four reel game and another of the games may be a standard five reel game. Similarly, the games 8 may each have different game symbols, game rules and pay tables that are unique to each game.

While one embodiment has been described in relation to a base game 8 and a feature game 9, it will be appreciated that the present disclosure could include one or more additional feature games that are triggered by specific trigger symbols appearing in the feature game 9 or 35. Also, the additional feature games may also have trigger symbols that trigger further feature games in a cascading fashion. These additional and further feature games could have the same game play elements as the feature games 9, 35 or be different feature games entirely.

In other embodiments, the base game 8 and the feature games 9, 35 need not be displayed alternately on a single video screen 7. Instead, they may be displayed on the same video screen 7, with the base game 8 shown in the lower playing area 7*a* and the feature games 9, 35 shown in the upper display area of the video screen 7. Alternatively, the base game 8 and the feature game 9, 35 are shown on separate video screens, with the base game 8 shown in a lower video screen corresponding to the lower playing area 7*a* and the feature game 9, 35 shown in an upper video screen corresponding to the upper display area. Also, the order can be reversed, with the lower playing area 7*a* or video screen showing the feature game 9, 35 and the upper video screen or upper playing area of a single video display screen 7 showing the base game 8.

In another embodiment, the video screen 7 is a touch screen for use in addition to the player-actuatable buttons 6 so as to enable the player to select the bet level (such as bet denominations or bet per pay line 14) as well as other various features, such as making monetary bets for the game, initiating play of any base and feature games played and responding to any messages or requests issued on the gaming machine 1 by the electronic game controller 4. In this case, the player may control when the reels 12 start spinning and stop spinning, either individually or collectively, by simply touching the reels 12. Control over spinning of the reels 12 can also be implemented through the buttons 6 on the console 3. This increases player interaction and provide the player with an opportunity to guess when a particular game symbol 10 may appear in the reels 12.

In some embodiments, in response to a feature game trigger event in the base game, the electronic controller causes the display to display game symbols for playing the feature game. Alternatively, the electronic controller causes the display of the feature game and the base game during play of the base game, the feature game being inactive until triggered. In this embodiment, the change in the feature game from being inactive to active may be indicated on the display. This indication may be visual, aural or a combination of both.

In some embodiments, the gaming machine comprises an input device for receiving commands from the player to play the game, wherein the input device comprises one or more buttons in electronic communication with the electronic controller to transmit the player commands to the electronic controller.

In some embodiments, the input device comprises one or more buttons on the housing, the buttons being in electronic communication with the electronic controller. In other embodiments, the buttons are arranged on a console of the housing. Alternatively or additionally, the input device comprises a touch sensitive surface on the display for receiving commands from the player, the touch sensitive surface being in electronic communication with the electronic game controller to transmit the player commands to the electronic controller.

In some embodiments, the gaming machine comprises a value transfer mechanism for receiving value from the player to make a bet and initiate a play of the game. In other embodiments, the value transfer mechanism also pays the prizes to the player using value in an amount equal to an awarded prize. It is further preferred that the housing comprises the value transfer mechanism. In one embodiment, the value transfer mechanism comprises one or more vending slots for paying and/or receiving value. In other embodiments, the value transfer mechanism comprises a value input/value output device. In further embodiments, the value transfer mechanism comprises a coin slot or acceptor, a paper currency acceptor, a ticket reader and/or printer or a card reader and/or writer.

In some embodiments, the game enhancing element comprises at least one or more of a predetermined number of free games, a win multiplier, wild multipliers, bonus wilds, symbols that cause the award of additional free games, trigger symbols to retrigger the at least two second arrays, held columns, random wild symbols, stacked symbols, bonus symbols, new game symbols, reveal symbols, progressives, bonus credits, jackpot symbols, and one or more symbol replacements.

In some embodiments, the base game and the feature game each comprises an array of rows and columns of the predetermined game positions, and the base game array is different in size and/or dimensions to the feature game array. In other embodiments, the feature game array is greater in size than the base game array. In one preferred form, the base array comprises three rows and five columns and the feature game array comprises either more than three rows or more than five columns. In a further preferred form, the feature game array is an extended base game array.

In some embodiments, a feature game trigger event occurs in the base game to trigger the feature game. In one embodiment, the feature game trigger event comprises a random event determined by the electronic game controller at the start of play of the feature game. In another embodiment, the feature game trigger event comprises the appearance of at least one trigger symbol in the base game array. In another alternative, the feature game trigger event comprises an in-game event during play of the base game.

In some embodiments, the array (including the base game array and/or the feature game array) take any one of a circular, triangular, oval, semi-circular, hexagonal, pentagonal, octagonal, non-rectangular or polygonal shape. In one preferred form, the wheels and the enhanced wheels arrays take the form of partially shown circular wheels.

In some embodiments, the player selectively starts and/or stops play of the base game array and/or the feature game array.

In some embodiments, the game symbols may be used to play a slots-type game. In other embodiments, the game symbols may be used to play a poker-type game. In further embodiments, the game symbols may be used to play a bingo or keno-type game In some embodiments, the gaming machine comprises a mobile electronic gaming device. In other embodiments, the mobile electronic gaming device comprises a handheld electronic device. In one preferred form, the handheld electronic device comprises a handheld electronic gaming device or a smart phone. Alternatively, the gaming machine comprises a computer. In other embodiments, the computer is connected to a communication network.

It will be appreciated that while the preferred embodiments have been described in relation to an industry standard electronic gaming machine, the present disclosure can be readily applied to other types of electronic gaming machines, including a personal computer (standing alone or connected to a communications network, LAN or WAN), mobile electronic devices (such as handheld or portable electronic devices like tablets and smart phones) and other electronic devices capable of displaying a game. In the case of mobile electronic device, in one arrangement it may permit the player to make bets using "virtual" credits that represent a monetary value, but do not require the player to make a monetary transaction. Instead, the present disclosure may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the present disclosure is implemented on a personal computer (PC) connected to the internet (wirelessly or not). In one example of the implementation, the PC would access an online casino over the internet to play the game of the present disclosure or the game of the present disclosure would be part of a social networking website. It is also contemplated that the player could also make regular payments to subscribe to continue playing the game on the mobile electronic device, PC or other electronic device.

In an alternative embodiment, the gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the present disclosure includes a computer programme configured to perform the present disclosure. In this way the present disclosure can be implemented in various ways on a gaming machine. In a further aspect, the present disclosure includes a gaming system configured comprising a central processing unit (such as a computer or computational processor) configured for communication with a gaming machine to perform the present disclosure. In a yet another aspect, the present disclosure includes a non-transitory computer readable or carrier medium carrying computer executable code that, when executed on a central processing unit configured for communication with a gaming machine, causes the central processing unit to perform the present disclosure. In this case, the non-transitory carrier medium includes an external hard drive, a memory device, including a memory card, smart card, a radio frequency identification (RFID) device, USB key, magnetic card or other electronic storage device.

While the illustrated embodiments include an electronic display on which the array of game positions is displayed, it will be recognized that the disclosed embodiments could instead incorporate mechanical or electro-mechanical reels to define the array of game positions. In fact, to the extent that the game positions, game symbols or operation of the gaming machine described herein would require a modification of such mechanical or electro-mechanical reels, it will be recognized that the embodiment represents a change in the structure or operation of a machine, rather than simply a variation in the rules of playing a game. In addition or in the alternative, the variation in the game positions, game symbols or operation of the gaming machine described herein may be viewed as analogous to a method for utilizing a new game apparatus (like a new deck of cards), rather than simply as a new set of rules in and of themselves.

It will further be appreciated that any of the features in the preferred embodiments of the present disclosure can be combined together and are not necessarily applied in isolation from each other. For example, the feature of the player being able to selectively starting or stopping spinning of the reels 12 and the feature of providing separate video screens for the lower playing area 7*a* and upper display area can be combined into a single gaming machine 1. Similar combinations of two or more features from the above described embodiments or embodiments of the present disclosure can be readily made by one skilled in the art.

By providing bonus symbols associated with bonus value awards that are allocated to an array that are awarded as more bonus symbols are added to the array, the embodiments of the present disclosure increase the chance of winning additional prizes and increasing the amount of game symbols that can be used on the display for playing the game. The embodiments of the present disclosure also add greater value to a player in terms of providing an entertaining way in winning these additional prizes and providing greater variety in game play, especially compared to a conventional gaming machine that only has one set of reels and a single feature game. All these advantages of the present disclosure result in the player being more likely to retain interest in continuing to play the same gaming machine due to the variation in game play on the gaming machine. Furthermore, since the electronic controller controls operation of the gaming machine, the present disclosure can be readily implemented to existing gaming machines, including EGMs, electro-mechanical or purely mechanical gaming machines as well as other gaming systems. In all these respects, the present disclosure represents a practical and commercially significant improvement over the prior art.

In conclusion, although the preceding text sets forth a detailed description of different embodiments of the present disclosure, it should be understood that the legal scope of the present disclosure is defined by the words of the claims set forth at the end of this patent. The detailed description is to be construed as exemplary only and does not describe every possible embodiment of the present disclosure since describing every possible embodiment would be impractical, if not impossible. Numerous alternative embodiments could be implemented, using either current technology or technology developed after the filing date of this patent, which would still fall within the scope of the claims defining the present disclosure.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The invention claimed is:

1. A gaming machine comprising:

at least one display; and an electronic controller coupled to the at least one display, the electronic controller being configured to display a first game on the at least one display including one or more configurations of game symbols, one or more of the configurations of game symbols being associated with a winning game outcome, the winning game outcome being associated with a value award payable to a player; and a value transfer mechanism for receiving value from the player, wherein the electronic controller communicates with the value transfer mechanism such that when a threshold amount of value has been received from the value transfer mechanism, the electronic controller initiates a play of the first game;

the electronic controller being further configured to:

randomly determine whether to display one or more bonus symbols in the first game, each bonus symbol being associated with a bonus value award;

in response to a trigger event occurring in a first play of the first game, display a collection of bonus symbols on the at least one display; and add the one or more bonus symbols from the first game to the collection, wherein the collection comprises a predetermined number of collection positions occupied by the bonus symbols including the one or more bonus symbols from the first game, additional bonus symbols are added to the collection of bonus symbols, and one of more bonus symbols are transferred from the collection of bonus symbols when the number of bonus symbols exceeds the predetermined number of collection positions, each transferred bonus symbol moving to a win meter that increments by the amount of the bonus value award associated with the transferred bonus symbol.

2. The gaming machine of claim 1, wherein the trigger event comprises the appearance of a predetermined number of bonus symbols in the first play of the first game.

3. The gaming machine of claim 2, wherein the predetermined number of bonus symbols appearing in the first play of the first game are initially arranged in the collection corresponding to their respective positions in the first play of the first game.

4. The gaming machine of claim 3, wherein the first game comprises a plurality of reels, and each of the predetermined number of bonus symbols appearing in the first play of the first game are initially arranged in collection positions of the collection corresponding to their respective reels in the first play of the first game.

5. The gaming machine of claim 1, wherein bonus symbols are sequentially transferred from the collection in response to bonus symbols being added to the collection.

6. The gaming machine of claim 1, wherein the bonus symbols in the collection move from one collection position to another collection position when additional bonus symbols are added to the collection.

7. The gaming machine of claim 6, wherein the bonus symbol occupying a designated exit collection position is transferred from the collection when the additional bonus symbols are added to the collection and are moved to a win meter so that the amount of the win meter increases by the amount of the bonus value award associated with the transferred bonus symbols.

8. The gaming machine of claim 1, wherein the collection positions define at least one path along which the bonus symbols move from an entry collection position to an exit collection position.

9. The gaming machine of claim 8, wherein the bonus symbol occupying the exit collection position is transferred from the collection when a bonus symbol is added to the entry collection position and is moved to a win meter so that the amount of the win meter increases by the amount of the bonus value award associated with the transferred bonus symbol.

10. The gaming machine of claim 1, wherein the bonus symbols are arranged in a predetermined order in the collection.

11. The gaming machine of claim 10, wherein the bonus symbols are transferred from the collection according to the predetermined order when the additional bonus symbols are added to the collection.

12. The gaming machine of claim 1, wherein the first game comprises a base game and a feature game, the first play of the first game being a play of the base game.

13. The gaming machine of claim 1, wherein the at least one display comprises a first display and a second display, wherein the first game is shown on the first display and the collection is shown on the second display.

14. A gaming machine comprising:

at least one electronic video display;

a value input comprising at least one of a coin acceptor, a bill acceptor, and a ticket reader; and an electronic controller coupled to the at least one electronic video display and the value input, the electronic controller is configured:

to determine if a wager has been received via the value input;

to display a first game on the at least one electronic video display if a wager has been received, a play of the first game including a plurality of randomly selected game symbols arranged in a plurality of reels, one or more of the configurations of the randomly selected game symbols arranged along a pay line being associated with a winning game outcome, the winning game outcome being associated with a value award payable to a player;

to randomly determine whether to display one or more bonus symbols on the reels in the first game, each bonus symbol being associated with a bonus value award;

in response to a trigger event occurring in a first play of the first game, to display a collection of bonus symbols on the at least one electronic video display separate to the reels for one or more plays of a second game; and add the one or more bonus symbols from the first game to the collection, wherein the collection comprises a predetermined number of collection positions occupied by the bonus symbols including the one or more bonus symbols from the first game, additional bonus symbols are added to the collection of bonus symbols, and one of more bonus symbols are transferred from the collection of bonus symbols when the number of bonus symbols exceeds the predetermined number of collection positions, each transferred bonus symbol moving to a win meter that increments by the amount of the bonus value award associated with the transferred bonus symbol.

15. The gaming machine of claim 14, wherein bonus symbols are sequentially transferred from the collection in response to bonus symbols being added to the collection.

16. The gaming machine of claim 14, wherein the trigger event comprises the appearance of a predetermined number of bonus symbols in the first play of the first game.

17. The gaming machine of claim 16, wherein the predetermined number of bonus symbols appearing in the first play of the first game are initially arranged in the collection corresponding to their respective positions in the first play of the first game.

18. The gaming machine of claim 17, wherein each of the predetermined number of bonus symbols appearing in the first play of the first game are initially arranged in collection positions of the collection corresponding to the respective reels in the first play of the first game.

19. The gaming machine of claim 14, wherein the collection positions define at least one path along which the bonus symbols move from an entry collection position to an exit collection position.

20. The gaming machine of claim 19, wherein the bonus symbol occupying the exit collection position is transferred from the collection when a bonus symbol is added to the entry collection position and is moved to a win meter so that the amount of the win meter increases by the amount of the bonus value award associated with the transferred bonus symbol.

* * * * *